US007171813B2

(12) United States Patent
Tanaka et al.

(10) Patent No.: US 7,171,813 B2
(45) Date of Patent: Feb. 6, 2007

(54) FUEL INJECTION NOZZLE FOR GAS TURBINE COMBUSTOR, GAS TURBINE COMBUSTOR, AND GAS TURBINE

(75) Inventors: Katsunori Tanaka, Hyogo (JP); Katsuya Yoshida, Hyogo (JP)

(73) Assignee: Mitsubishi Heavy Metal Industries, Ltd., Tokyo (JP)

( * ) Notice: Subject to any disclaimer, the term of this patent is extended or adjusted under 35 U.S.C. 154(b) by 34 days.

(21) Appl. No.: 10/440,470

(22) Filed: May 19, 2003

(65) Prior Publication Data

US 2004/0020210 A1 Feb. 5, 2004

(51) Int. Cl.
*F02C 1/00* (2006.01)

(52) U.S. Cl. ..... 60/737; 60/740; 60/748; 431/174

(58) Field of Classification Search ..... 60/737, 60/739, 740, 748, 746, 747, 742, 743, 760; 431/174

See application file for complete search history.

(56) References Cited

U.S. PATENT DOCUMENTS 5,193,346 A * 3/1993 Kuwata et al. ..... 60/737
5,259,184 A * 11/1993 Borkowicz et al. ..... 60/39.55
5,408,830 A * 4/1995 Lovett ..... 60/737
5,410,884 A * 5/1995 Fukue et al. ..... 60/267
5,435,126 A * 7/1995 Beaudoin ..... 60/39.463
5,471,840 A * 12/1995 Lovett ..... 60/737
5,901,555 A * 5/1999 Mandai et al. ..... 60/747
6,026,645 A * 2/2000 Stokes et al. ..... 60/737
6,038,861 A * 3/2000 Amos et al. ..... 60/737
6,047,551 A * 4/2000 Ishiguro et al. ..... 60/740
6,082,111 A * 7/2000 Stokes ..... 60/737
6,122,916 A * 9/2000 Amos et al. ..... 60/747
6,158,223 A * 12/2000 Mandai et al. ..... 60/737
6,327,861 B2 * 12/2001 Sato et al. ..... 60/746
6,357,237 B1 * 3/2002 Candy et al. ..... 60/737
6,539,724 B2 * 4/2003 Cornwell et al. ..... 60/776
6,594,999 B2 * 7/2003 Mandai et al. ..... 60/722
6,631,614 B2 * 10/2003 Mandai et al. ..... 60/737
6,634,175 B1 * 10/2003 Kawata et al. ..... 60/746
6,662,547 B2 * 12/2003 Mandai et al. ..... 60/39.55
6,675,581 B1 * 1/2004 Stuttaford et al. ..... 60/737
6,684,641 B2 * 2/2004 Moriya et al. ..... 60/737
6,688,107 B2 * 2/2004 Ono et al. ..... 60/725
6,691,516 B2 * 2/2004 Stuttaford et al. ..... 60/737
6,701,713 B2 * 3/2004 Mandai et al. ..... 60/737

(Continued)

FOREIGN PATENT DOCUMENTS

JP 6-2848 1/1994

(Continued)

*Primary Examiner*—William H. Rodriguez
(74) *Attorney, Agent, or Firm*—Armstrong, Kratz, Quintos, Hanson & Brooks, LLP.

(57) ABSTRACT

A fuel injection nozzle has a cylindrical nozzle body having a cavity where fuel passes through. A plurality of hollow spokes, each having an aerofoil cross section, are provided around the nozzle body. Each hollow spoke has four fuel injection holes in total on both side surfaces, i.e., two fuel injection holes on each side surface, to inject the fuel, with a distance from the surface of the nozzle body. The inside of each hollow spoke is hollow. The hollow spoke injects the fuel sent to the hollow nozzle body, from the fuel injection holes through the inside of the hollow spoke.

23 Claims, 23 Drawing Sheets

U.S. PATENT DOCUMENTS

| | | | | |
|---|---|---|---|---|
| 6,705,087 | B1 * | 3/2004 | Ohri et al. | 607/748 |
| 6,722,132 | B2 * | 4/2004 | Stuttaford et al. | 60/737 |
| 6,732,528 | B2 * | 5/2004 | Akagi et al. | 60/752 |
| 6,742,338 | B2 * | 6/2004 | Tanaka et al. | 60/737 |
| 6,772,594 | B2 * | 8/2004 | Nishida et al. | 60/737 |
| 2001/0022088 | A1 * | 9/2001 | Mandai et al. | 60/737 |
| 2002/0011064 | A1 * | 1/2002 | Crocker et al. | 60/39.06 |
| 2002/0011070 | A1 * | 1/2002 | Mandai et al. | |
| 2002/0014078 | A1 * | 2/2002 | Mandai et al. | 60/737 |
| 2002/0139121 | A1 * | 10/2002 | Cornwell et al. | 60/776 |
| 2002/0152740 | A1 * | 10/2002 | Suenaga et al. | 60/39.23 |
| 2002/0152751 | A1 * | 10/2002 | Mandai et al. | 60/746 |
| 2002/0189258 | A1 * | 12/2002 | Tanaka et al. | 60/737 |
| 2003/0037549 | A1 * | 2/2003 | Mandai et al. | 60/746 |
| 2003/0051478 | A1 * | 3/2003 | Matsuyama et al. | 60/725 |
| 2003/0110774 | A1 * | 6/2003 | Saitoh | 60/737 |
| 2003/0226361 | A1 * | 12/2003 | Stickles et al. | 60/776 |
| 2004/0003596 | A1 * | 1/2004 | Chin et al. | 60/737 |
| 2004/0006989 | A1 * | 1/2004 | Stuttaford et al. | 60/776 |
| 2004/0006990 | A1 * | 1/2004 | Stuttaford et al. | 60/776 |
| 2004/0006991 | A1 * | 1/2004 | Stuttaford et al. | 60/776 |
| 2004/0006992 | A1 * | 1/2004 | Stuttaford et al. | 60/776 |
| 2004/0006993 | A1 * | 1/2004 | Stuttaford et al. | 60/776 |
| 2004/0050057 | A1 * | 3/2004 | Bland et al. | 60/737 |
| 2004/0050058 | A1 * | 3/2004 | Ohri et al. | 60/748 |
| 2004/0055306 | A1 * | 3/2004 | North et al. | 60/737 |
| 2004/0060295 | A1 * | 4/2004 | Mandai et al. | 60/725 |
| 2004/0060297 | A1 * | 4/2004 | Koenig et al. | 60/737 |
| 2004/0079086 | A1 * | 4/2004 | Smith et al. | 60/776 |
| 2004/0093851 | A1 * | 5/2004 | Dawson | 60/39.37 |
| 2004/0144094 | A1 * | 7/2004 | Moriya et al. | 60/737 |
| 2004/0144095 | A1 * | 7/2004 | Moriya et al. | 60/737 |
| 2004/0148936 | A1 * | 8/2004 | Moriya et al. | 60/737 |
| 2004/0163392 | A1 * | 8/2004 | Nishida et al. | 60/737 |

FOREIGN PATENT DOCUMENTS

| | | |
|---|---|---|
| JP | 6-18037 | 1/1994 |
| JP | 2002-31343 | 1/2002 |

* cited by examiner

FUEL INJECTION NOZZLE FOR GAS TURBINE COMBUSTOR, GAS TURBINE COMBUSTOR, AND GAS TURBINE

BACKGROUND OF THE INVENTION

1) Field of the Invention

The present invention relates to a gas turbine combustor for a gas turbine. More particularly, this invention relates to a fuel injection nozzle for a gas turbine combustor that supplies fuel to air guided to the gas turbine combustor for the gas turbine, a gas turbine combustor that has this fuel injection nozzle, and a gas turbine that has the nozzle.

2) Description of the Related Art

A conventional gas turbine combustor has widely used a diffusion combustion system that injects fuel and combustion air from different nozzles, and burns the mixture. However, recently, in place of the diffusion combustion system, a premixed combustion system which is advantageous based on a reduction of thermal $NO_x$ has come to be used. The premixed combustion system refers to a system that mixes fuel and combustion air in advance, injects the mixture (hereinafter, "premixed gas") from one nozzle, and burns the mixture. According to this premixed combustion system, even if the ratio of the fuel to the premixed gas is low, the premixed gas is burned in all the combustion area. Therefore, it is easy to lower the temperature of the flame (hereinafter, "premixed flame") generated by the premixed gas. Consequently, this system is advantageous in the reduction of $NO_x$ as compared with the diffusion combustion system. On the other hand, this system has a problem in that the stability of combustion is inferior to that of the diffusion combustion system, and backfire and autoignition of the premixed gas occur.

FIG. 24 is a cross-sectional view in an axial direction that illustrates one example of a gas turbine combustor based on the premixed system. FIGS. 25A and 25B are diagrams to explain about a main fuel injection nozzle for the gas turbine combustor based on the premixed system used conventionally. Gas turbine combustor internal cylinders 20 are provided at constant intervals within a gas turbine combustor external cylinder 10. A diffusion flame formation corn 30 that stabilizes a premixed flame by forming a diffusion flame is provided at the center of each gas turbine combustor internal cylinders 20. The diffusion flame formation corn 30 forms the diffusion flame by reacting pilot fuel supplied from a pilot fuel injection nozzle 31 with combustion air supplied from between the gas turbine combustor external cylinder 10 and the gas turbine combustor internal cylinders 20.

A premixed flame formation nozzle 40 is provided around the diffusion flame formation corn 30 in advance. A main fuel injection nozzle 610 that injects main fuel, mixes the main fuel with the combustion air, and forms the premixed gas is provided inside the premixed flame formation nozzle 40. This main fuel injection nozzle 610 has a conical shape at a front end thereof. Fuel injection holes 61 that inject the main fuel are provided on the external surface of the main fuel injection nozzle 610. The main fuel injected from the fuel injection holes 61 is mixed with the combustion air supplied from between the gas turbine combustor external cylinder 10 and the gas turbine combustor internal cylinders 20, and the premixed gas is formed. This premixed gas is injected from the premixed flame formation nozzle 40 to a combustion chamber 50 via a premixed flame formation nozzle extension pipe 400.

A high-temperature combustion gas emitted from the diffusion flame ignites the premixed gas injected to the combustion chamber 50, thereby to form the premixed flame. The diffusion flame formed by the diffusion flame formation corn 30 stabilizes the premixed flame. A high-temperature and high-pressure combustion gas is emitted from the premixed flame. The combustion gas passes through a tailpipe, not shown, of the gas turbine combustor, and is guided to a turbine first stage nozzle.

As the above main fuel injection nozzle 610 is provided with the fuel injection holes 61 that inject the main fuel on the external surface of the main fuel injection nozzle 610, the main fuel is injected out along the surface of the main fuel injection nozzle 610. Therefore, this main fuel does not diffuse easily at the downstream, and there is a problem that it is not possible to homogeneously generate the premixed flame. In order to solve this problem, Japanese Patent Application Laid-open No. 6-2848 discloses a fuel injection nozzle that has a plurality of cylindrical spokes having a plurality of fuel injection holes in a radial direction of the fuel injection nozzle, and injects the fuel from the fuel injection holes provided on the spokes. FIG. 26A and FIG. 26B are diagrams to explain about the fuel injection nozzle according to this prior art.

A fuel injection nozzle 620 injects the fuel from the fuel injection holes 61 provided on cylindrical hollow spokes 68. Therefore, there is an advantage that it is easy to diffuse the fuel at the downstream of the hollow spokes 68, and that it is possible to keep a homogeneous and stable combustion state. However, as each hollow spoke 68 has a circular cross section, the flow of the combustion air is disturbed at the back of the hollow spoke 68, which has caused the occurrence of backfire.

SUMMARY OF THE INVENTION

It is an object of the present invention to at least solve the problems in the conventional technology.

The fuel injection nozzle according to one aspect of the present invention includes a nozzle body that has a first cavity where fuel flows; and a spoke that is provided on the nozzle body and has a leading edge, a trailing edge, a second cavity connected to the first cavity, and a hole from which the fuel is injected, wherein the hole is provided on a side of the spoke at a distance from a surface of the fuel injection nozzle body, and the distance is determined based on diffusion of the fuel.

The gas turbine combustor according to another aspect of the present invention includes a gas turbine combustor internal cylinder; a first nozzle that is disposed inside the gas turbine combustor internal cylinder, and mixes pilot fuel with air to generate a diffusion flame; a second nozzle that is provided on a circumference being concentric with the first nozzle, and mixes main fuel with air to generate a premixed flame; a diffusion corn that is attached at an outlet of the first nozzle to diffuse the pilot fuel mixed; and a premixed gas guide that is attached at the outlet of the second nozzle to guide the main fuel mixed to an inner peripheral surface of the gas turbine combustor internal cylinder.

The gas turbine combustor according to still another aspect of the present invention includes a gas turbine combustor internal cylinder; a first nozzle that is disposed inside the gas turbine combustor internal cylinder, and has a first hole into which a main fuel flows; a spoke that is provided on an inner peripheral surface of the first nozzle and has a leading edge, a trailing edge, a cavity connected to the first hole, and a second hole from which the main fuel is injected; and a second nozzle that is disposed inside the first nozzle, and mixes pilot fuel with air.

The gas turbine according to still another aspect of the present invention includes a compressor that compresses air; a gas turbine combustor that generates combustion gas from the air, wherein the gas turbine combustor includes a gas turbine combustor internal cylinder; a first nozzle that is disposed inside the gas turbine combustor internal cylinder, and mixes pilot fuel with air to generate a diffusion flame; a second nozzle that is provided on a circumference being concentric with the first nozzle, and mixes main fuel with air to generate a premixed flame; a diffusion corn that is attached at an outlet of the first nozzle to diffuse the pilot fuel mixed; and a premixed gas guide that is attached at the outlet of the second nozzle to guide the main fuel mixed to an inner peripheral surface of the gas turbine combustor internal cylinder; and a turbine that is driven by the combustion gas generated.

The gas turbine according to still another aspect of the present invention includes a compressor that compresses air; a gas turbine combustor that generates combustion gas from the air, wherein the gas turbine combustor includes a gas turbine combustor internal cylinder; a first nozzle that is disposed inside the gas turbine combustor internal cylinder, and has a first hole into which a main fuel flows; a spoke that is provided on an inner peripheral surface of the first nozzle and has a leading edge, a trailing edge, a cavity connected to the first hole, and a second hole from which the main fuel is injected; and a second nozzle that is disposed inside the first nozzle, and mixes pilot fuel with air; and a turbine that is driven by the combustion gas generated.

The other objects, features and advantages of the present invention are specifically set forth in or will become apparent from the following detailed descriptions of the invention when read in conjunction with the accompanying drawings.

DETAILED DESCRIPTION

Exemplary embodiments relating to the present invention will be explained in detail below with reference to the accompanying drawings. The present invention is not limited to the embodiments. Constituent elements in the following embodiments include those which persons skilled in the art could easily assume or which are substantially identical elements.

Figure 1A:
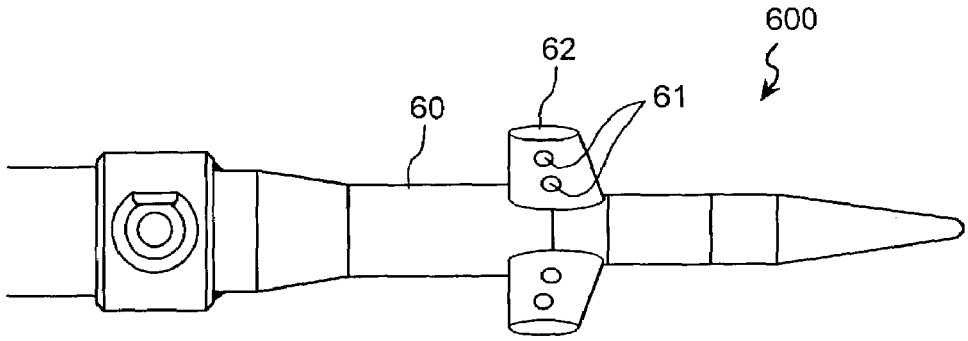
FIGS. 1A to 1C are diagrams to explain about a fuel injection nozzle for a gas turbine combustor of a first embodiment according to the present invention.
Figure 1B:
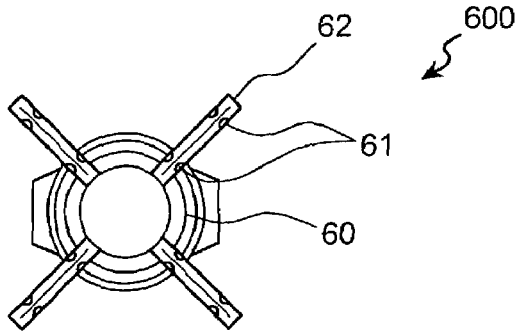
Figure 1C:
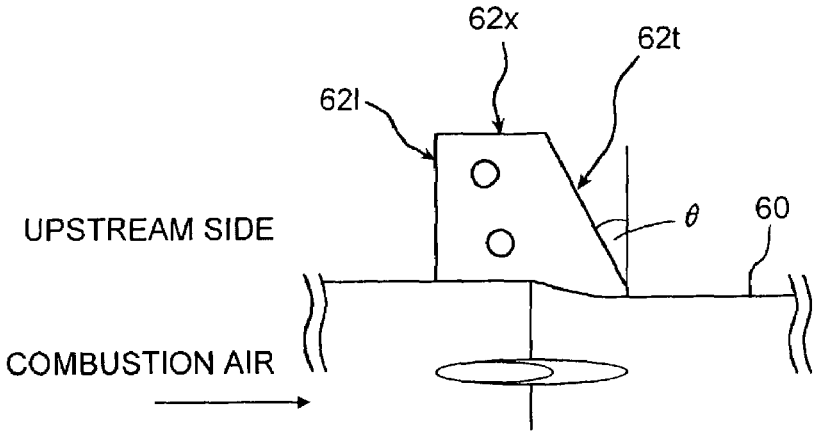

FIGS. 1A to 1C are diagrams to explain about a fuel injection nozzle for a gas turbine combustor of a first embodiment according to the present invention. As shown in FIGS. 1A to 1C, a fuel injection nozzle 600 according to this embodiment has a cylindrical nozzle body 60. The cylindrical nozzle body 60 has a cavity where fuel flows.

A plurality of hollow spokes 62, each having an aerofoil cross section, are radially provided around the nozzle body 60 as shown in FIG. 1B. Each hollow spoke 62 has four fuel injection holes 61 in total on both side surfaces, i.e., two fuel injection holes 61 on each side surface, to supply fuel, with a distance from the surface of the nozzle body 60. Each hollow spoke 62 has a cavity where the fuel flows, and the cavity is connected to the cavity of the cylindrical nozzle body 60. The hollow spoke 62 injects the fuel sent to the hollow nozzle body 60, from the fuel injection holes 61 through the inside of the hollow spoke 62. The number of the fuel injection holes 61 increases with decrease in the diameters of the fuel injection holes 61. When the diameters of the fuel injection holes 61 are too small, the supply of the fuel becomes unstable. Therefore, while the number of the fuel injection holes 61 is not limited to four, it is preferable to determine the number within a range of diameters so as to stably supply the fuel. While the number of the fuel injection holes 61 depends on their diameters, one to four, preferably two or three fuel injection holes 61 are provided on each side surface.

FIG. 1C illustrates a state that the hollow spoke 62 has a sweptforward angle θ. With this arrangement, combustion air flows smoothly along a trailing edge 62*t* of the hollow spoke 62. Therefore, it is possible to suppress disturbance of the combustion air, thereby to suppress backfire. As a result, it is possible to suppress burnout of the premixed flame formation nozzle and make its life long. Therefore, it is preferable to provide the sweptforward angle θ in the hollow spoke 62 as shown in FIG. 1C. The sweptforward angle θ refers to an inclination angle θ of the trailing edge 62*t* that is inclined toward the upstream of the flow direction of the combustion air, that is, toward the axis of the cylindrical nozzle body 60. The trailing edge 62*t* of the hollow spoke 62 is one of two edges of the hollow spoke 62 having the aerofoil cross section and is the edge at the downstream of the flow direction of the combustion air. The other edge at the upstream is called a leading edge 621.

The fuel injection nozzle 600 has the fuel injection holes 61 that inject the fuel. The fuel injection holes 61 are provided on the side surfaces of the hollow spokes 62 with a distance from the surface of the cylindrical nozzle body 60. Because of the provision of these fuel injection holes 61, the fuel can easily diffuse at the downstream of the hollow spokes 62. The mixed gas of the fuel and the combustion air burns homogeneously, and thus the flame generated by the mixed gas does not have a local high-temperature area. As a result, the fuel injection nozzle 600 can reduce the generation of $NO_x$ more than the conventional fuel injection nozzle.

Conventionally, the cross section of each hollow spoke in a circumferential direction is circular. This circular shape allows the combustion air to whirl at the downstream of the hollow spoke and flow far away from the surface of the hollow spoke, and thus causes a backfire. On the other hand, since the hollow spoke 62 according to the this embodiment has the aerofoil cross section, the combustion air flows smoothly, and disturbance of the combustion air is reduced at the downstream of the hollow spoke 62. Therefore, it is possible to suppress the generation of $NO_x$ and suppress backfire by diffusing the fuel to the combustion air. Consequently, it is possible to reduce the burnout of the nozzle extension pipe and the like, and it is possible to make long the life of the gas turbine combustor. It is also possible to reduce the trouble of maintenance and inspection.

While the cross section of each hollow spoke 62 is aerofoil, the cross section can also take a plate shape thereby to suppress the disturbance of the combustion air at the downstream of the hollow spoke 62. When the cross section of the hollow spoke 62 has a plate shape, it is possible to manufacture the hollow spokes 62 easily, although the effect of suppressing the disturbance of the combustion air is slightly less than the effect when the cross section is aerofoil.

When a swirler is used to give a swirl to the combustion air, the hollow spoke 62 may be inclined toward the axial direction of the nozzle body 60 so that the hollow spoke 62 is parallel with the flow direction of the combustion air that is given the swirl by the swirler. Precisely, the hollow spoke 62 is provided so that a chord line connecting the leading edge 62*l* and the trailing edge 62*t* is nonparallel to the axis of the nozzle body. With this arrangement, the combustion air whose direction is changed by the swirler flows smoothly along the surface of the hollow spoke 62. Therefore, it is possible to reduce the disturbance of the combustion air at the downstream of the hollow spoke 62. As a result, the swirler can sufficiently mix the combustion air with the fuel, and it becomes possible to reduce $NO_x$ by suppressing the generation of a local high-temperature area, and reduce the burnout of the nozzle extension pipe and the like by suppressing the occurrence of backfire.

Figure 2A:
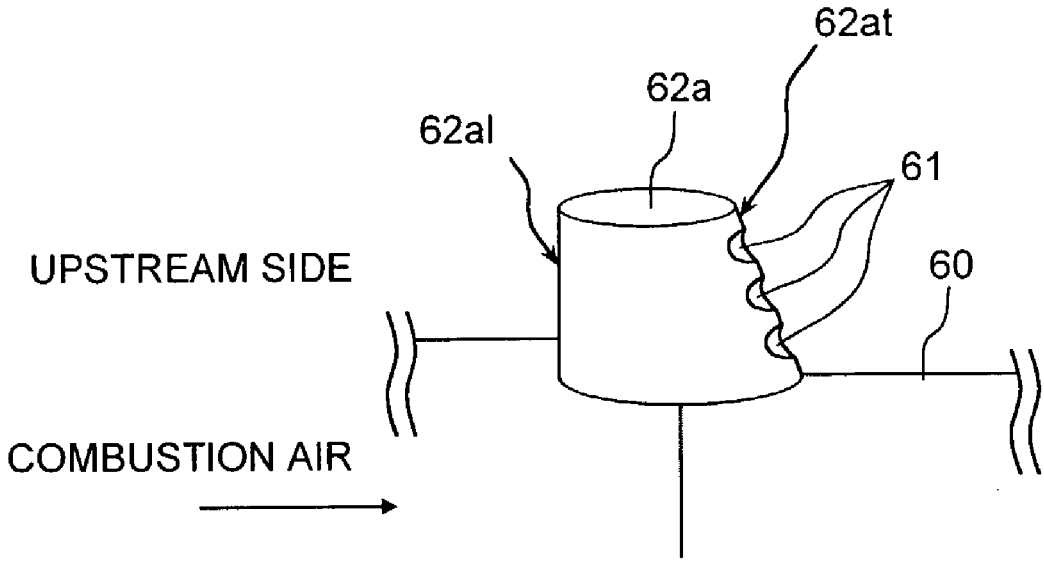
FIGS. 2A and 2B are diagrams to explain about a modification of a hollow spoke of the first embodiment according to the present invention.
Figure 2B:
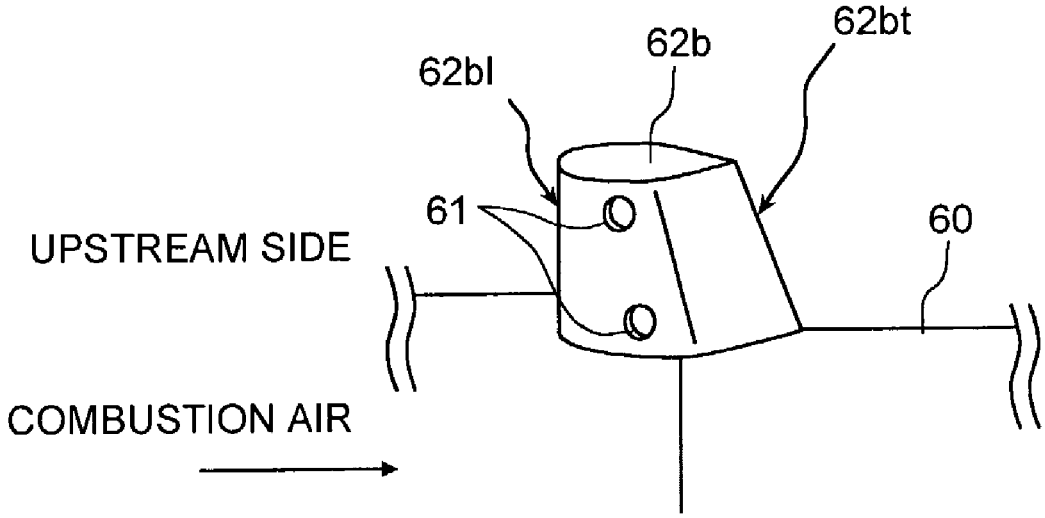

FIGS. 2A and 2B are diagrams to explain about a modification of the hollow spoke of the first embodiment according to the present invention. As shown in FIG. 2A, the fuel injection holes 61 may be provided at a trailing edge 62 at of a hollow spoke 62*a* at the downstream of the flow direction of the combustion air. This structure is applied particularly to a liquid fuel such as gas oil and fuel oil.

As shown in FIG. 2B, the cross section of a hollow spoke 62*b* may have a semicircular shape at a leading edge 62*b*1 thereof, with a taper portion provided at the downstream thereof. Further, the blade thickness of the hollow spoke 62*b* may become smoothly small at the slip stream side of the fuel injection hole 61. With this arrangement, only the upstream edge of the hollow spoke 62*b* is formed with a curvature, and other portions are formed with a plane surface. Therefore, it becomes easy to manufacture the hollow spoke 62*b*.

Figure 3A:
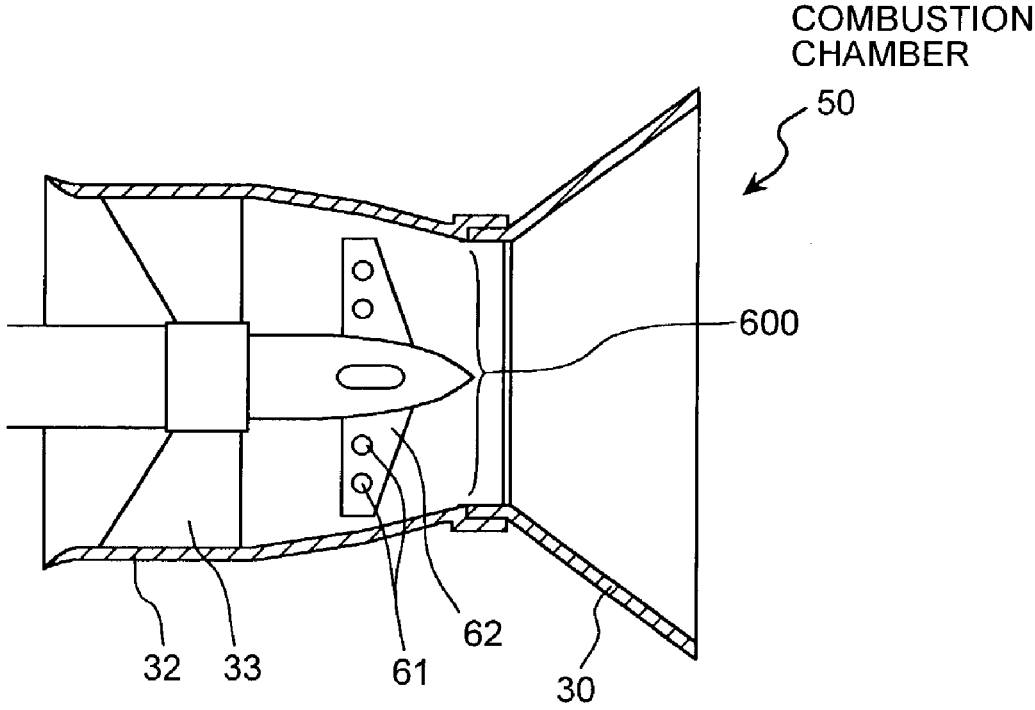
FIGS. 3A and 3B are diagrams to explain about an example of an application of the fuel injection nozzle to a diffusion flame formation nozzle.
Figure 3B:
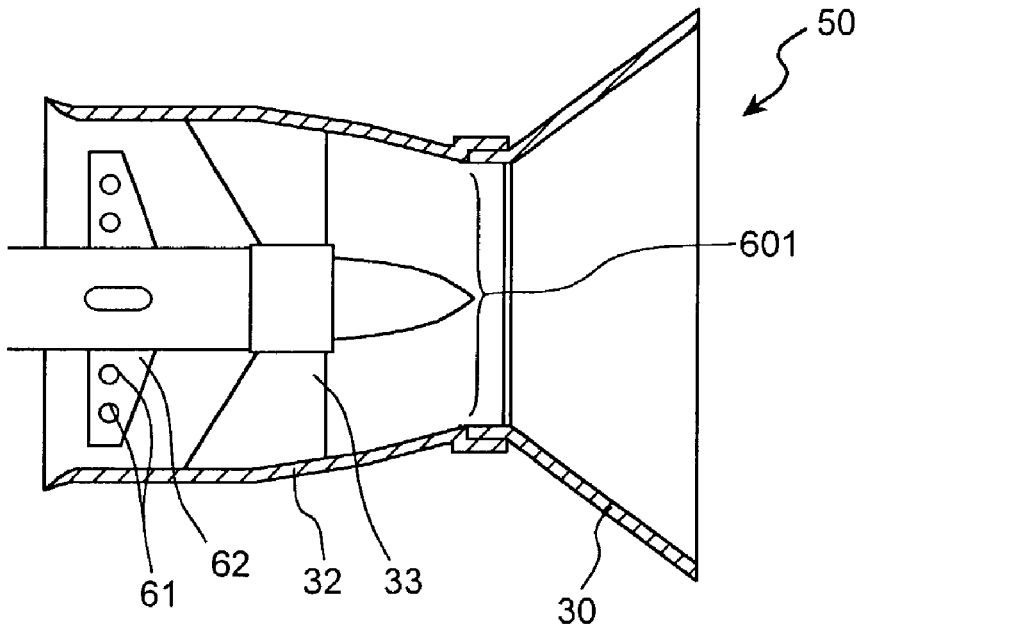

FIGS. 3A and 3B are diagrams to explain about an example of an application of the fuel injection nozzle 600 to a diffusion flame formation nozzle. As shown in FIG. 3A, the fuel injection nozzle 600 according to the present embodiment may be applied to a diffusion flame formation nozzle 32. With this arrangement, the fuel can easily diffuse at the downstream of the hollow spoke 62. Therefore, the combustion air and the fuel are mixed sufficiently, and it becomes possible to burn the mixture homogeneously.

Further, as shown in FIG. 3B, the hollow spokes 62 may be disposed at the upstream of a swirler 33. With this arrangement, the swirler 33 disposed at the downstream of the hollow spokes 62 generates pressure loss in the air that flows into the diffusion flame formation nozzle 32. This pressure loss stirs the air, and mixes the fuel and air sufficiently within the diffusion flame formation nozzle 62. As a result, the fuel and air burn more homogeneously, and it becomes possible to more suppress the generation of a local high-temperature area.

Figure 4A:
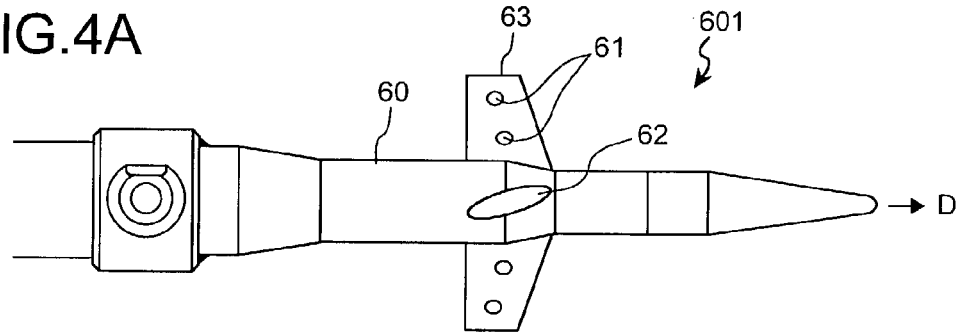
FIGS. 4A and 4B are diagrams to explain about a fuel injection nozzle for a gas turbine combustor of a second embodiment according to the present invention.
Figure 4B:
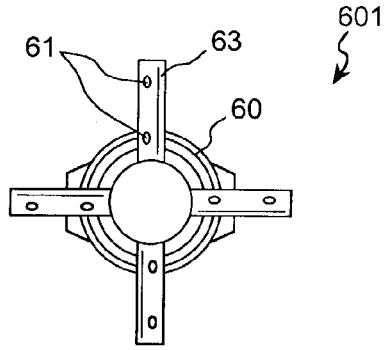

FIGS. 4A and 4B are diagrams to explain about a fuel injection nozzle for a gas turbine combustor of a second embodiment according to the present invention. As shown in FIGS. 4A and 4B, a fuel injection nozzle 601 according to the present embodiment has hollow spokes 63 inclined toward the flow direction (direction of arrow mark D in FIG. 4A) of the combustion air. With this arrangement, it is possible to give a swirl to the combustion air. Therefore, it is possible to sufficiently mix the fuel with the combustion air at the downstream of the hollow spoke 63.

As a result, it is possible to suppress the generation of a local high-temperature area, and it becomes possible to further reduce the generation of $NO_x$. Each hollow spoke 63 having an aerofoil cross section does not allow the combustion air to flow far away from the surface of the hollow spoke 63, and the flow of the combustion air is not disturbed at the downstream of the hollow spoke 63. Therefore, it is possible to suppress backfire. Further, since the hollow spokes 63 give a swirl to the combustion air, depending on the level of the swirl, it is not necessary to use a swirler provided in the vicinity of the inlet of premixed flame formation nozzle.

Figure 5A:
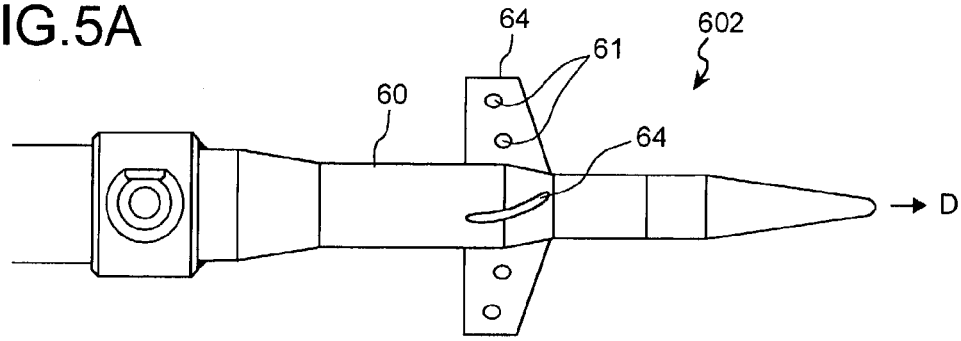
FIGS. 5A and 5B are diagrams to explain about a modification of the fuel injection nozzle of the second embodiment according to the present invention.
Figure 5B:
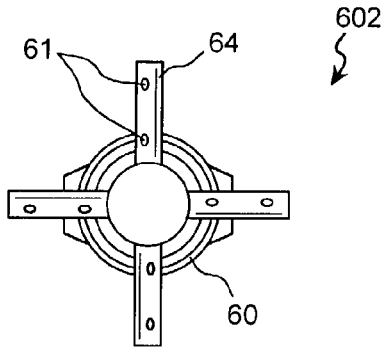

FIGS. 5A and 5B are diagrams to explain about a modification of the fuel injection nozzle of the second embodiment according to the present invention. As shown in FIGS. 5A and 5B, a fuel injection nozzle 602 has hollow spokes 64 inclined with a curvature toward the flow direction (direction of arrow mark D in FIG. 5A) of the combustion air. Precisely, each hollow spoke 64 has such an aerofoil cross section that a chord line connecting the leading edge and the trailing edge is curved. Since the hollow spoke 64 has an aerofoil cross section and is inclined with a curvature toward the flow direction of the combustion air, the combustion air flows not far away from but along the surface of the hollow spokes 64. Therefore, it is possible to more suppress the disturbance of the flow, and it becomes possible to further reduce backfire.

Figure 6A:
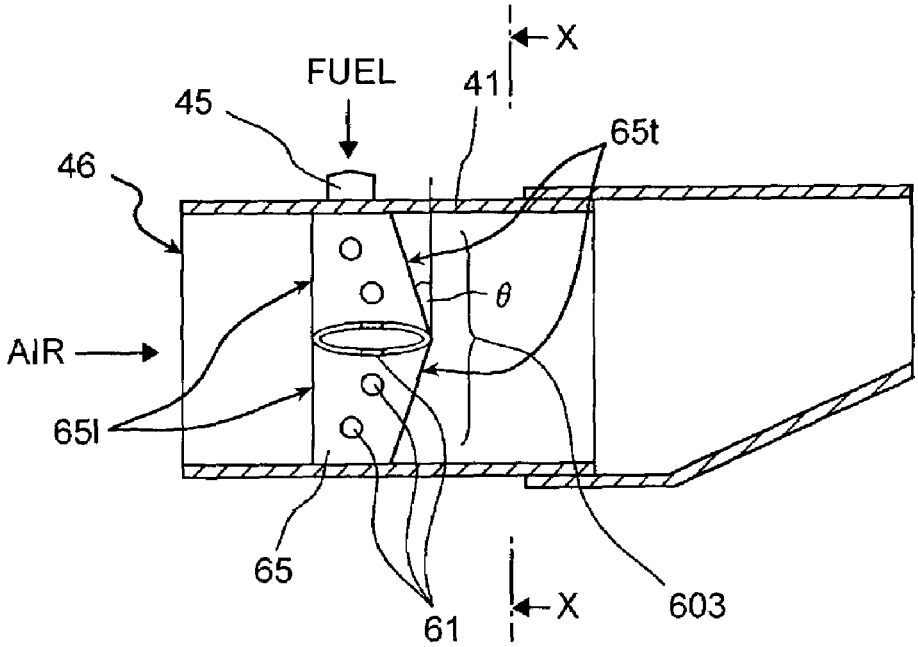
FIGS. 6A and 6B are diagrams to explain about a fuel injection nozzle for a gas turbine combustor of a third embodiment according to the present invention.
Figure 6B:
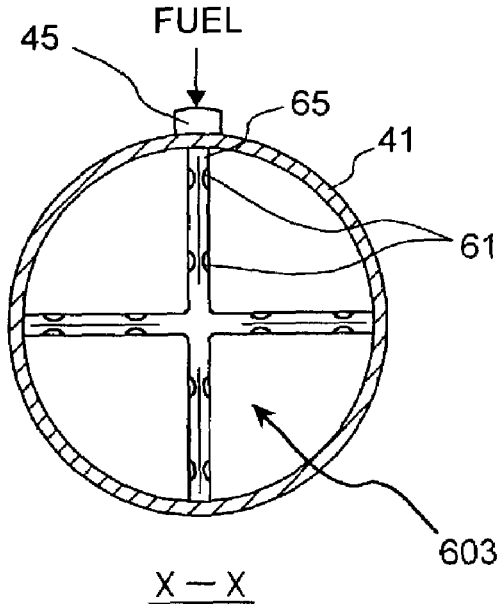

FIGS. 6A and 6B are diagrams to explain about a fuel injection nozzle for a gas turbine combustor of a third embodiment according to the present invention. As shown in FIGS. 6A and 6B, a fuel injection nozzle 603 according to the present embodiment has hollow spokes 65 fitted to the inner wall of a flame formation nozzle 41. This flame formation nozzle 41 includes a nozzle that mixes fuel with combustion air to form a premixed gas, and forms a premixed flame based on the premixed gas, and a nozzle that injects the fuel to the combustion air to burn the fuel, and forms a diffusion combustion flame. Further, the flame formation nozzle 41 includes a nozzle that injects a mixed gas of pilot fuel and combustion air and a premixed gas, and forms a premixed flame in a second application to be described later.

As shown in FIGS. 6A and 6B, the fuel injection nozzle 603 that includes four hollow spokes 65, each having an aerofoil cross section, is provided on the inner wall of a flame formation nozzle 41. The inside of each hollow spoke 65 is hollow. Main fuel is sent from a fuel supply section 45 provided at the outside of the flame formation nozzle 41, and is supplied to each hollow spoke 65. Each hollow spoke 65 has four fuel injection holes 61 in total on both side surfaces, i.e., two fuel injection holes 61 on each side surface, to inject the main fuel. It is possible to apply the same diameter and the same number of each fuel injection hole 61 as those explained in the first embodiment. Cross sections of the hollow spokes 65 according to the present embodiment form a cross shape. The cross sections are perpendicular to the axial direction of the flame formation nozzle 41. While the four hollow spokes 65 are used, the number of the hollow spokes 65 is not limited to four.

A trailing edge 65*t* of each hollow spoke 65 has a sweptforward angle θ. It is preferable to provide this a sweptforward angle θ as it is possible to suppress separation of air thereby to suppress backfire. From the viewpoint of suppressing the separation of air at the trailing edge 65*t* of each hollow spoke 65, the sweptforward angle θ is preferably 10 to 30 degrees, and more preferably 15 to 25 degrees.

The combustion air that flows from an inlet 46 of the flame formation nozzle 41 is mixed with the fuel injected from the fuel injection holes 61 to the inside of the flame formation nozzle 41. The fuel injection nozzle 603 according to the present embodiment does not have the cylindrical nozzle body 60 (see FIGS. 1A to 1C) at the center thereof, unlike the main fuel injection nozzle 600 explained in the first embodiment. Therefore, the cross sectional area through which the combustion air passes inside the flame formation nozzle 41 is larger than that when the fuel injection nozzle 600 explained in the first embodiment is used. Consequently, when the quantities of the combustion air that flow in both cases are the same, it is possible to make smaller the internal diameter of the flame formation nozzle 41. As a result, it is possible to make compact the gas turbine combustor as a whole.

In this embodiment, when a swirler is used to give a swirl to the combustion air, the hollow spokes 65 may be fitted with an inclination toward the axial direction of the flame formation nozzle 41. With this arrangement, the combustion air whose direction is changed by the swirler flows smoothly along the surface of the hollow spokes 65. Therefore, it is possible to reduce the disturbance of the combustion air at the downstream of the hollow spoke 65. As a result, the swirler can sufficiently mix the combustion air with the fuel, and it becomes possible to reduce $NO_x$ by suppressing the generation of a local high-temperature area, and reduce the burnout of the nozzle extension pipe and the like by suppressing the occurrence of backfire.

As explained in the second embodiment, the hollow spokes 65 of the fuel injection nozzle 603 according to the present embodiment may be inclined toward the flow direction of the combustion air to give a swirl to the combustion air, thereby to sufficiently mix the combustion air with the main fuel. Depending on the level of the swirl, it is not necessary to use the swirler to give a swirl to the combustion air.

Figure 7:
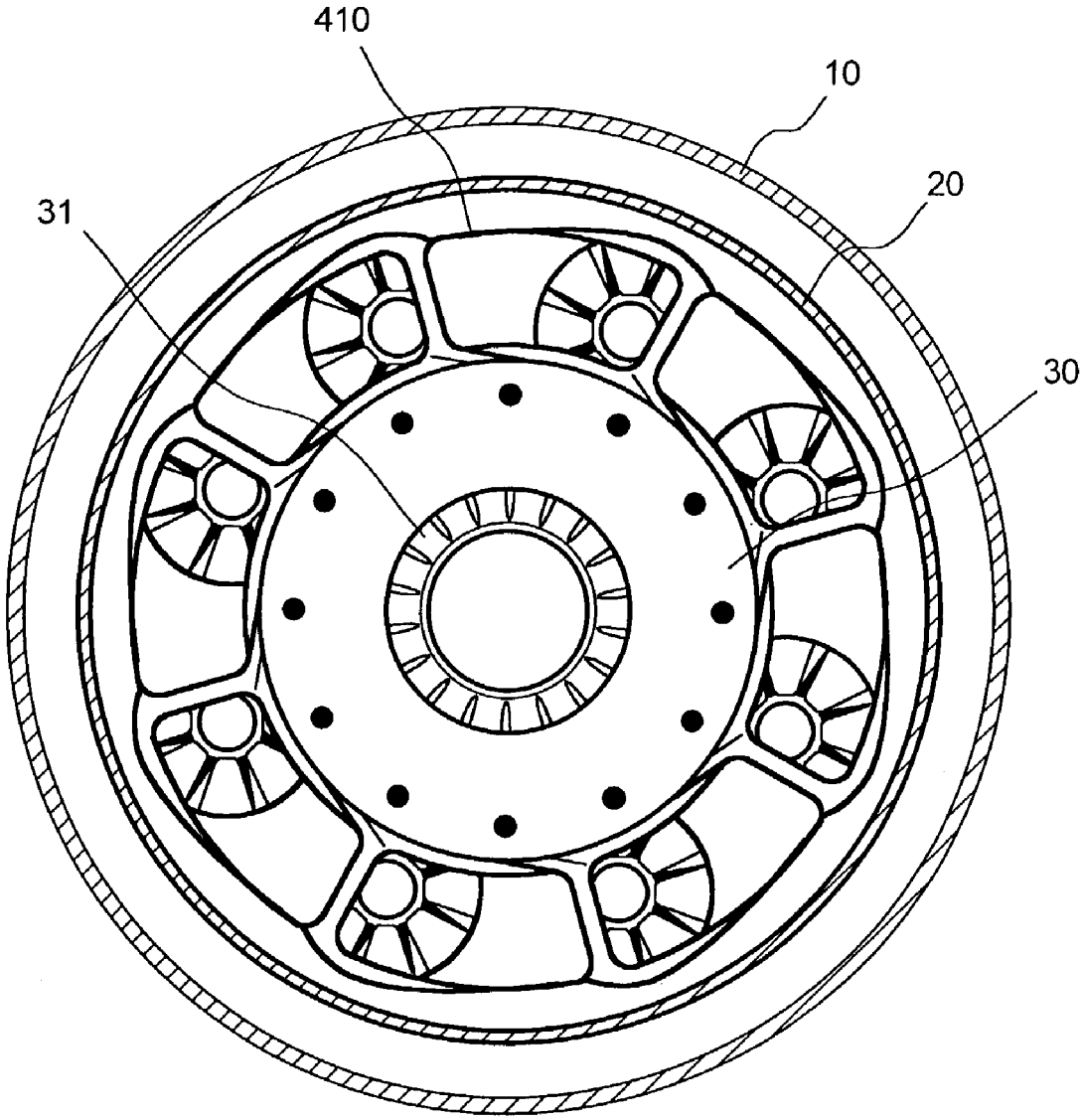
FIG. 7 is a front view of the fuel injection nozzle according to the present invention that is applied to a gas turbine combustor as a first application example.
Figure 8:
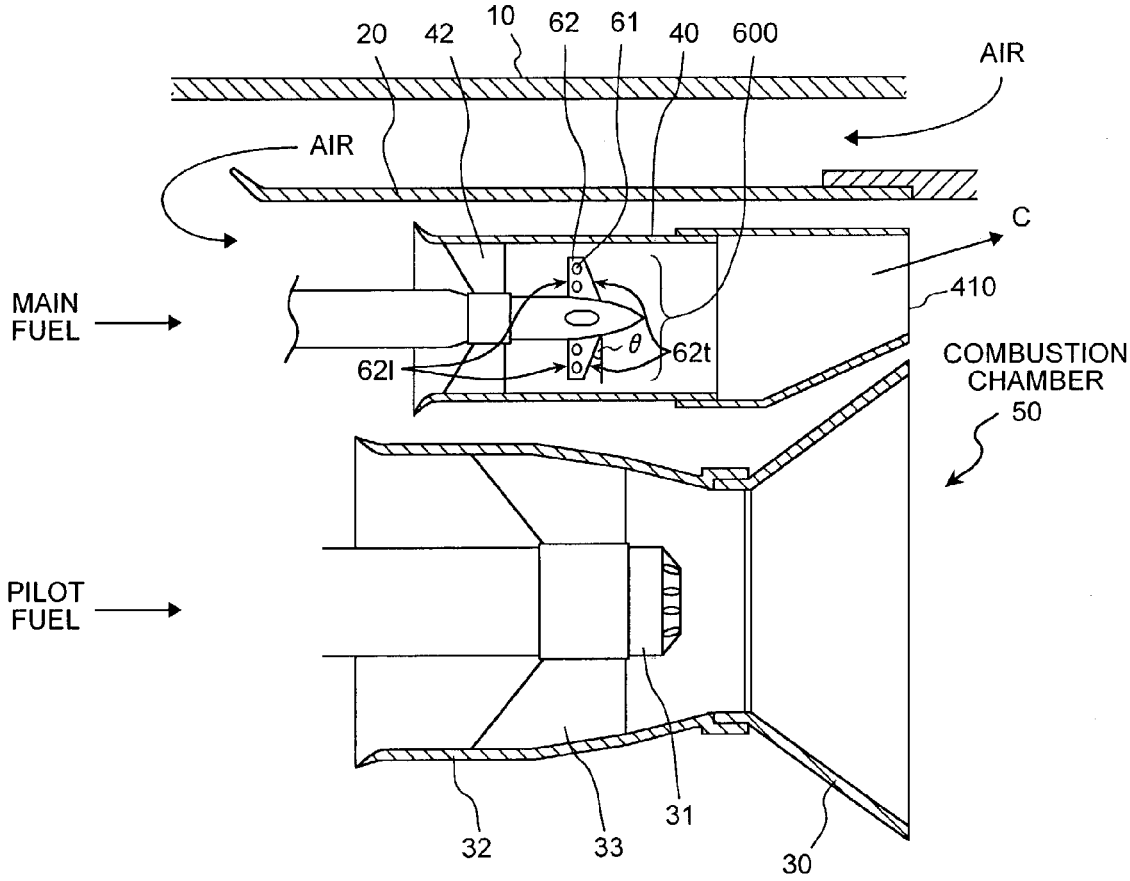
FIG. 8 is a cross-sectional view in an axial direction of the gas turbine combustor shown in FIG. 7.
Figure 9:
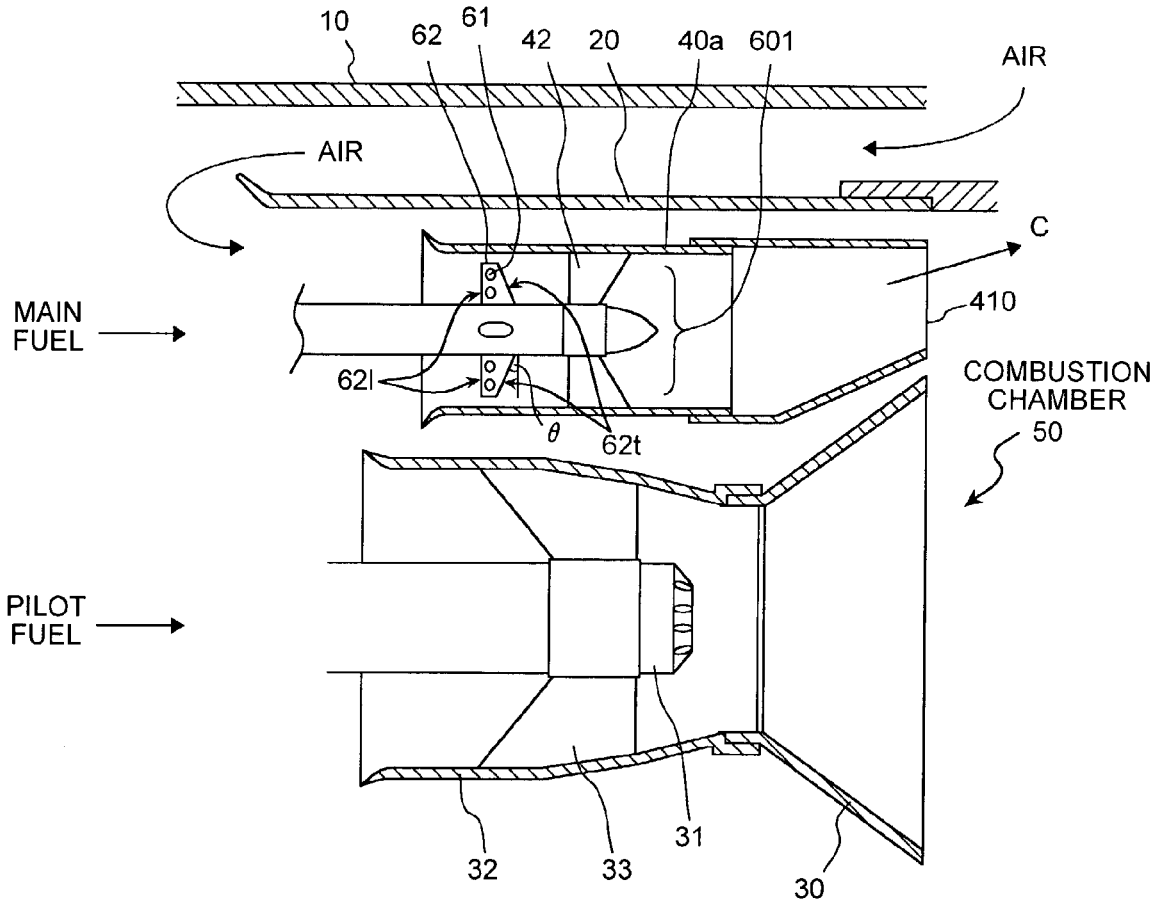
FIG. 9 is a cross-sectional view in an axial direction of the fuel injection nozzle according to the present invention that is applied to a gas turbine combustor as a second application example.
Figure 10:
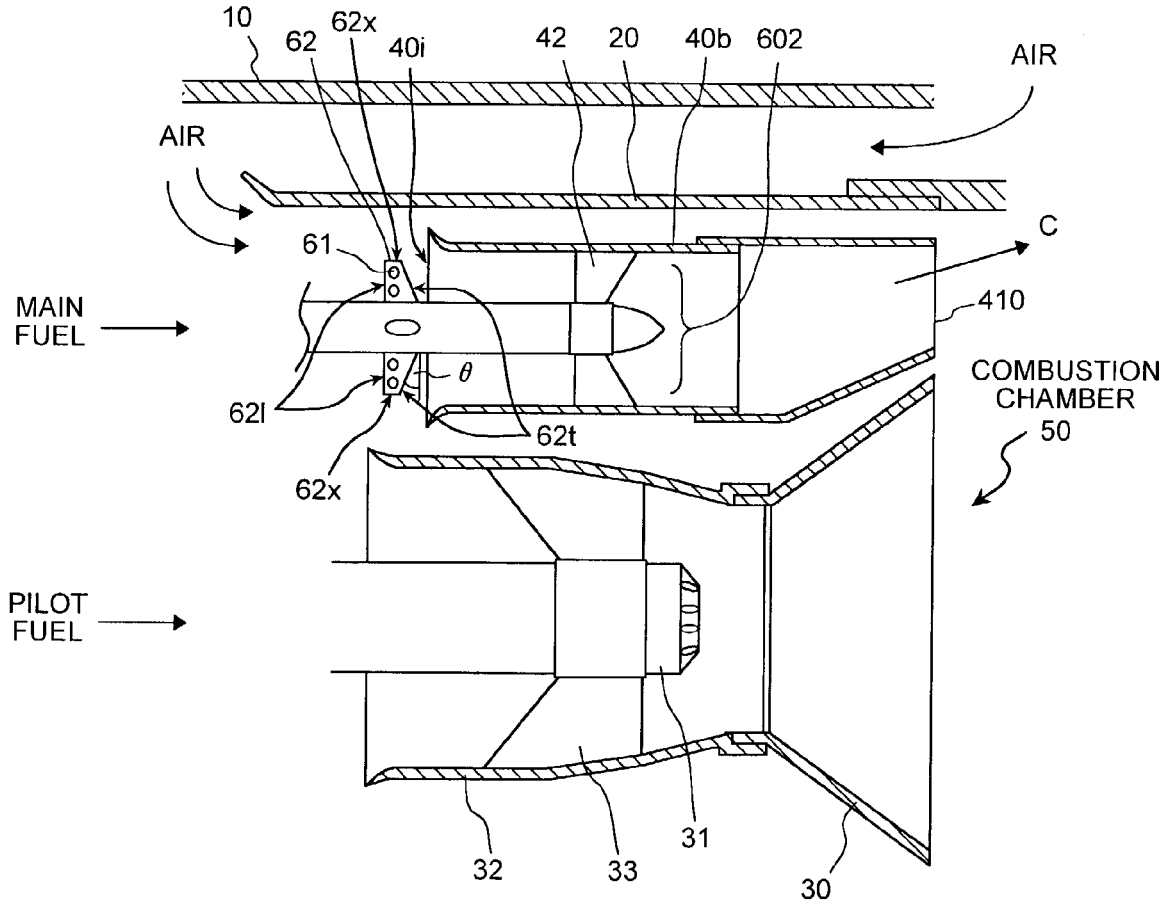
FIG. 10 is a cross-sectional view in an axial direction of the fuel injection nozzle according to the present invention that is applied to a gas turbine combustor as a third application example.
Figure 11A:
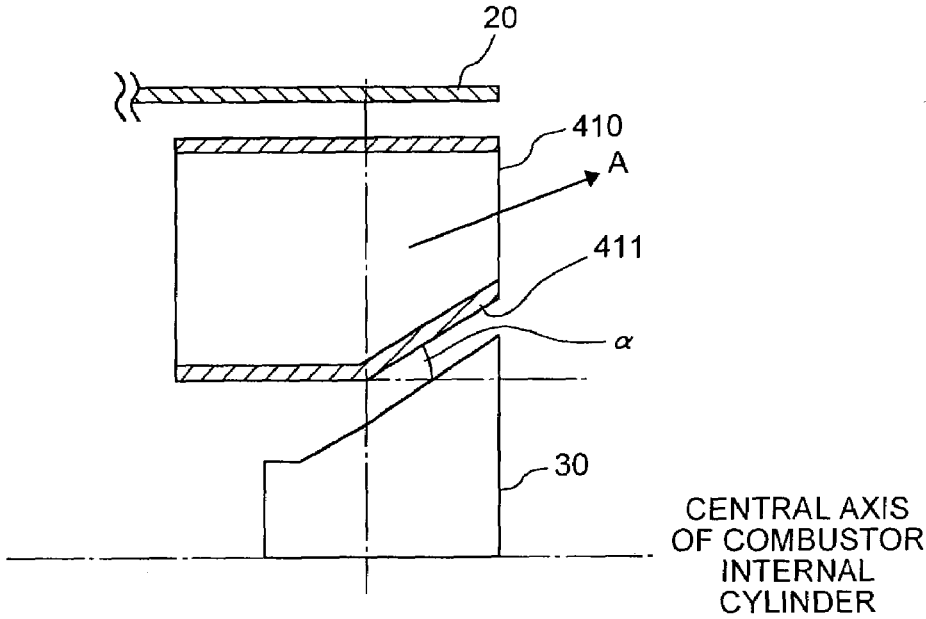
FIGS. 11A and 11B are cross-sectional views in an axial direction of a premixed flame formation nozzle extension pipe used in the gas turbine combustor.
Figure 11B:
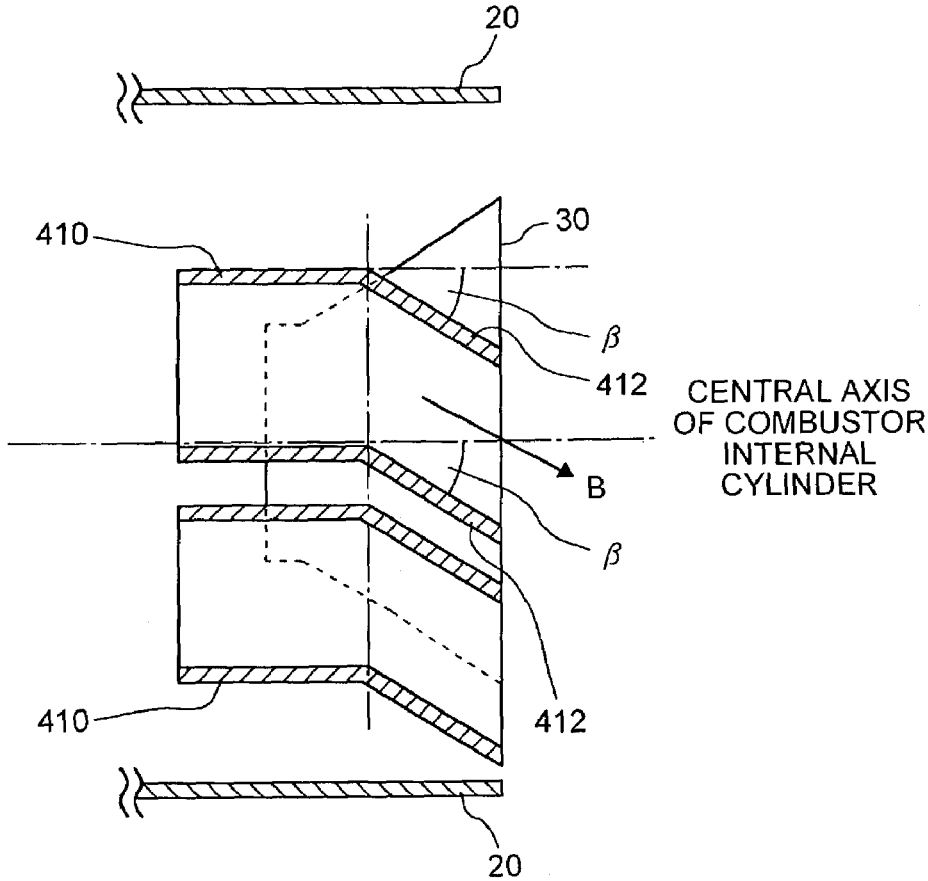

Examples of applications of the fuel injection nozzle according to the present invention to a gas turbine combustor are explained next. FIG. 7 is a front view of the fuel injection nozzle according to the present invention that is applied to a gas turbine combustor as a first application example. FIG. 8 is a cross-sectional view in an axial direction of the gas turbine combustor shown in FIG. 7. FIG. 9 is a cross-sectional view in an axial direction of the fuel injection nozzle according to the present invention that is applied to a gas turbine combustor as a second application example. FIG. 10 is a cross-sectional view in an axial direction of the fuel injection nozzle according to the present invention that is applied to a gas turbine combustor as a third application example. FIGS. 11A and 11B are cross-sectional views in an axial direction of a premixed flame formation nozzle extension pipe that is used in the gas turbine combustor. In the following application examples, the applications of the fuel injection nozzle 600 (refer to FIGS. 1A to 1C) explained in the first embodiment is explained. It is also possible to similarly apply the fuel injection nozzles explained in the second and third embodiments.

As shown in FIG. 7 and FIG. 8, the diffusion flame formation corn 30 is provided inside the gas turbine combustor internal cylinder 20. The pilot fuel injection nozzle 31 that injects the pilot fuel is provided inside the diffusion flame formation corn 30. The pilot fuel injected from the pilot fuel injection nozzle 31 reacts with the combustion air, and forms a diffusion combustion flame. The swirler 33 that stirs the combustion air is provided around the pilot fuel injection nozzle 31. The swirler 33 sufficiently mixes the combustion air with the pilot fuel. The diffusion flame formation corn 30 injects the gas mixture of the combustion air and the pilot fuel to the combustion chamber 50 (see FIG. 8), and forms the diffusion combustion flame.

As shown in FIG. 8, the premixed flame formation nozzles 40 are disposed between the gas turbine combustor internal cylinder 20 and the diffusion flame formation corn 30 that forms the diffusion combustion flame. Although not clear from FIG. 8, eight premixed flame formation nozzles 40 are disposed around the diffusion flame formation corn 30. The number of the premixed flame formation nozzles 40 is not limited to eight, and it is possible to suitably increase or decrease the number according to the specification of the gas turbine combustor.

As shown in FIG. 7 and FIG. 8, a premixed flame formation nozzle extension pipe (hereinafter, "nozzle extension pipe") 410 is provided as a premixed flame formation nozzle extension section at the outlet of the premixed flame formation nozzle 40. The premixed gas is injected to the combustion chamber 50 via the nozzle extension pipe 410.

As shown in FIG. 7, the outlet of the nozzle extension pipe 410 has a sectorial shape. Based on this, intervals between adjacent nozzle extension pipes 410 become substantially constant. Therefore, air flows homogeneously from the adjacent nozzle extension pipes 410. Consequently, it is possible to suppress the backflow of high-temperature combustion gas to an area where the flow of air is weak. As a result, it is possible to reduce the burnout of portions of the nozzle extension pipes 410 that are adjacent to each other. Further, air flows substantially homogeneously from between the adjacent nozzle extension pipes 410, between the nozzle extension pipes 410 and the gas turbine combustor internal cylinder 20, and between the nozzle extension pipes 410 and the diffusion flame formation corn 30. Therefore, it is possible to suppress backfire attributable to inhomogeneous flow of air, and it becomes possible to reduce the burnout of the nozzle extension pipes 410.

Of side portions of each nozzle extension pipe 410 that exists in a radial direction of the gas turbine combustor internal cylinder 20, at least a side portion 411 near the central axis of the gas turbine combustor internal cylinder 20 is inclined toward the outside of the radial direction of the gas turbine combustor internal cylinder 20 at a constant angle $\alpha$ from a plane perpendicular to the central axis of the gas turbine combustor internal cylinder 20 (see FIG. 11A). Further, as shown in FIG. 11B, a side portion 412 of each nozzle extension pipe 410 that exists in the circumferential direction of the gas turbine combustor internal cylinder 20 is inclined toward the circumferential direction of the gas turbine combustor internal cylinder 20 at a constant angle $\beta$ from a plane perpendicular to the central axis of the gas turbine combustor internal cylinder 20.

As explained above, by inclining each nozzle extension pipe 410 toward the outside of the radial direction of the gas turbine combustor internal cylinder 20, it is possible to give an outward flow to the premixed gas (as shown by arrow mark A in FIG. 11A). Further, by inclining each nozzle extension pipe 410 to the circumferential direction, it is possible to give a rotation in the circumferential direction of the gas turbine combustor internal cylinder 20 to the premixed gas (as shown by arrow mark B in FIG. 11B). It is possible to select suitably optimum values for the angles $\alpha$ and $\beta$ according to the specifications of the gas turbine combustor. From the viewpoint of effectively forming a recirculation area, it is preferable to set the angles $\alpha$ and $\beta$ to within a range from 20 degrees to 50 degrees. Further, from the viewpoint of minimizing the pressure loss in the nozzle extension pipes 410 and effectively forming a recirculation area, it is preferable to set the angles $\alpha$ and $\beta$ to within a range from 30 degrees to 40 degrees.

The flow of air is explained with reference to FIG. 8. Air sent from a compressor, not shown, is guided into the gas turbine combustor external cylinder 10. The air passes through between the gas turbine combustor external cylinder 10 and the gas turbine combustor internal cylinder 20, and changes the flow direction by 180 degrees. Then, the air is sent from behind the gas turbine combustor internal cylinder 20 to the premixed flame formation nozzle 40 and the diffusion flame formation nozzle 32, and is mixed with the main fuel and the pilot fuel.

The swirler 33 provided within the diffusion flame formation nozzle 32 stirs the compressed air guided into the diffusion flame formation nozzle 32, and sufficiently mixes the compressed air with the pilot fuel injected from the pilot fuel injection nozzle 31. Both mixed gases form the diffusion flame, and this diffusion flame is injected out from the diffusion flame formation corn 30 to the combustion chamber 50. This diffusion flame causes the premixed gas prepared by the premixed flame formation nozzle 40 to be combusted quickly. This diffusion flame stabilizes the combustion of the premixed gas, and suppresses backfire of the premixed flame and autoignition of the premixed gas.

A swirler 42 provided within the premixed flame formation nozzle 40 stirs the compressed air guided into the premixed flame formation nozzle 40. The compressed air is sufficiently mixed with the main fuel injected from the fuel injection holes 61 provided on the hollow spokes 62 of the fuel injection nozzle 600, and a premixed gas is formed. The premixed gas is injected from the nozzle extension pipes 410 to the combustion chamber 50. As the fuel injection holes 61 are provided with a distance from the surface of the nozzle body 60, the main fuel sufficiently diffuses to the compressed air as the combustion air, and is mixed with the compressed air. As it is necessary to suppress the generation of $NO_x$, the premixed gas is in a state that air is excess for the fuel. This high-temperature combustion gas emitted from the diffusion flame quickly ignites the premixed gas, and forms the premixed flame. High-temperature and high-voltage combustion gas is emitted from the premixed flame.

In the premixed flame formation nozzle 40 shown in FIG. 8, the hollow spokes 62 are disposed at the downstream of the swirler 42. It is also possible to dispose the hollow spokes 62 at the upstream of the swirler 42 like a premixed flame formation nozzle 40*a* shown in FIG. 9. With this arrangement, the swirler 42 disposed at the downstream of the hollow spokes 62 generates a pressure loss in the combustion gas that is a mixture of the main fuel and air within the premixed flame formation nozzle 40*a*. Since the combustion gas is stirred based on the pressure loss, the fuel and air in the combustion gas are mixed more homogeneously. Since the combustion gas combusts more homogeneously, it is possible to more suppress the generation of local high-temperature portions, which is preferable as it is possible to further reduce the generation of $NO_x$.

Like a premixed flame formation nozzle 40*b* shown in FIG. 10, the trailing edge 62*t* of an end portion 62*x* of each hollow spoke 62 may be positioned at the upstream of an inlet 40*i* of the premixed flame formation nozzle 40*b*. With this arrangement, the air that enters the inlet 40*i* of the premixed flame formation nozzle 40*b* flows into the premixed flame formation nozzle 40*b* from between the inlet 40*i* of the premixed flame formation nozzle 40*b* and the trailing edge 62*t* of the end portion 62*x* of each hollow spoke 62. Based on this, it is possible to supply sufficient quantity of air to the premixed flame formation nozzle 40*b*. Therefore, it is possible to reduce the generation quantity of $NO_x$. The trailing edge 62*t* is the edge at the downstream of the flow direction of the combustion air out of the two edges 621 and 62*t* that the hollow spoke 62 has as shown in FIG. 10. The edge at the opposite of the trailing edge is the leading edge 621.

As shown in FIG. 10, the trailing edge 62*t* of each hollow spoke 62 may have the sweptforward angle θ. Based on the provision of the sweptforward angle θ, air flows smoothly along the trailing edge 62*t*. Therefore, it is possible to suppress the generation of backfire. As a result, it is possible to suppress burnout of the premixed flame formation nozzle 40*b*, and it is possible to make long the life of the premixed flame formation nozzle 40*b*. It is also possible to reduce the trouble of maintenance and inspection, which is preferable. From the viewpoint of suppressing the separation of air at the trailing edge 62*t* of each hollow spoke 62, the sweptforward angle θ is preferably 10 to 30 degrees, and more preferably 15 to 25 degrees.

As explained above, at least a side portion of each nozzle extension pipe 410 near the central axis of the gas turbine combustor internal cylinder 20 is inclined toward the inner wall side of the gas turbine combustor internal cylinder 20 with the constant angle α from the axial direction of the gas turbine combustor internal cylinder 20. The outlet of each nozzle extension pipe 410 is inclined at the constant angle β from the axial direction of the gas turbine combustor internal cylinder 20. Therefore, the combustion gas within the combustion chamber 50 flows spirally around the axis of the gas turbine combustor internal cylinder 20. In other words, the combustion gas forms what is called an outward spiral flow.

Figure 12A:
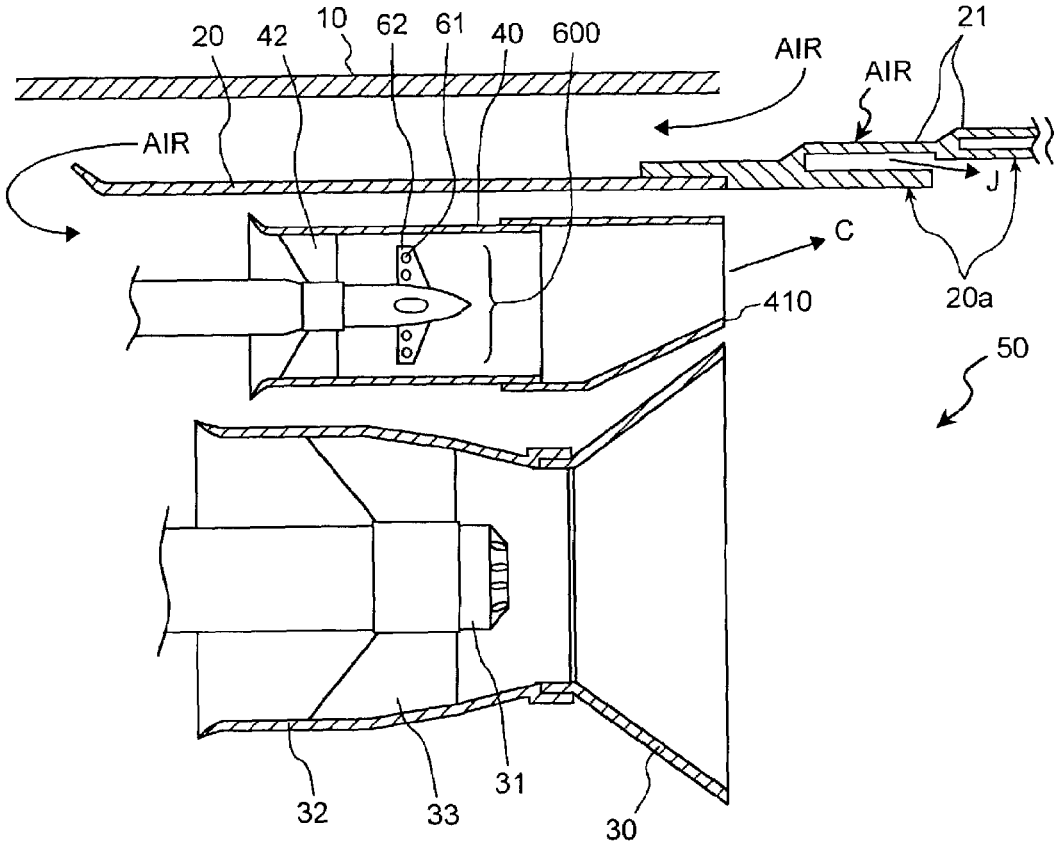
FIGS. 12A and 12B are cross-sectional views in an axial direction of a gas turbine combustor internal cylinder provided with a cooling unit.
Figure 12B:
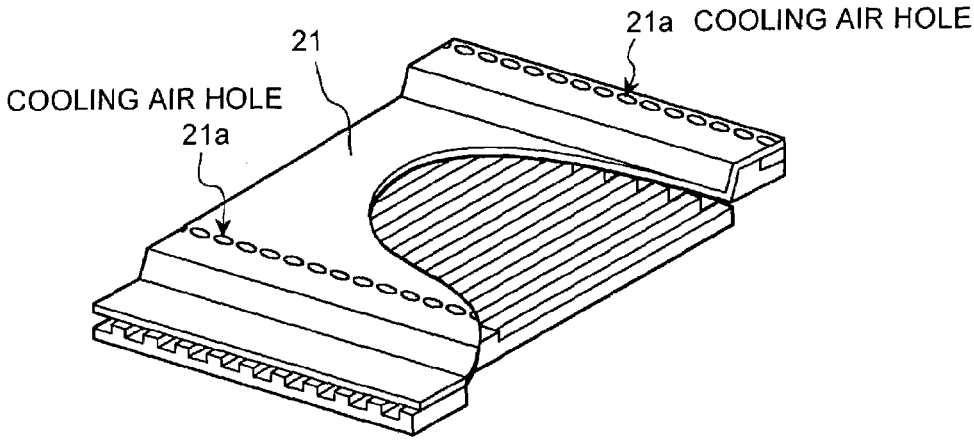

The cooling of the gas turbine combustor internal cylinder 20 is explained next. FIGS. 12A and 12B are cross-sectional views in an axial direction of a gas turbine combustor internal cylinder provided with a cooling unit. As the combustion gas flows in the gas turbine combustor according to the present invention forms the outward spiral flow, the combustion gas collides against the gas turbine combustor internal cylinder 20*a* at the combustion chamber 50 side (as shown by arrow mark C in FIG. 12A). Therefore, the combustion gas in a gas turbine combustor internal cylinder 20*a* at the combustion chamber 50 side becomes a high temperature, which could shorten the life of this portion.

In order to avoid the above problem, it is preferable that a cooling unit is provided around the gas turbine combustor internal cylinder 20*a* at the combustion chamber 50 side, thereby to remove the heat of the combustion gas from the gas turbine combustor internal cylinder 20*a*. In the example shown in FIGS. 12A and 12B, the gas turbine combustor internal cylinder 20*a* at the combustion chamber 50 side is structured by using a plate fin 21. FIG. 12B shows a structure of the plate fin 21. First, the air from the compressor passed through between the gas turbine combustor external cylinder 10 and the gas turbine combustor internal cylinder 20 flows into the plate fin 21 from cooling air holes 21*a* (refer to FIG. 12B) that are provided at the gas turbine combustor external cylinder 10 side of the plate fin 21. When this air flows inside the plate fin 21, the air cools the internal cylinder at the combustion chamber 50 side based on the convection cooling. The air that has flown through the inside of the plate fin 21 flows out to the combustion chamber 50 side (in arrow mark J direction in FIG. 12A). This air flows along the surface of the gas turbine combustor internal cylinder 20*a* at the combustion chamber 50 side, and forms a temperature boundary layer in the vicinity of the surface, thereby to film cool the internal cylinder at the combustion chamber 50 side.

The cooling unit is not limited to the plate fin. It is possible to use a fin called an MT fin. It is also possible to provide holes around the gas turbine combustor internal cylinder 20*a* at the combustion chamber 50 side, and the cooling air may be injected from these holes to film cool the gas turbine combustor internal cylinder 20*a* at the combustion chamber 50 side. Based on these cooling units, even when high-temperature combustion gas is injected to the inner peripheral surface of the internal cylinder at the combustion chamber 50 side, this surface portion is cooled. Therefore, it is possible to suppress an increase in a local temperature of the gas turbine combustor internal cylinder 20*a* at the combustion chamber 50 side. Consequently, it is possible to provide the outward flow more positively, and it becomes possible to further promote the mixing of the premixed gas.

According to the conventional gas turbine combustor, the combustion gas swirls toward the center of the gas turbine combustor, and forms what is called an inward spiral flow. Therefore, the premixed gas is concentrated to the vicinity of the center of the combustion chamber 50. Consequently, the combustion proceeds quickly at this portion, which easily generates a local high-temperature area. As a result, it is not possible to sufficiently suppress the generation of $NO_x$. Further, as the recirculation area is not sufficiently formed, the premixed flame becomes unstable, and combustion oscillation and the like are generated.

On the other hand, in the gas turbine combustor to which the fuel injection nozzle 600 according to the present invention is applied, the fuel injection nozzle 600 provided within the premixed flame formation nozzle 40 sufficiently mixes the premixed gas. Therefore, it is possible to suppress the generation of a local high-temperature area. Further, according to this gas turbine combustor, each nozzle extension pipe 410 has a constant angle. Based on this, the outward spiral flow is given to the premixed gas to direct the premixed gas toward the outside of the radial direction of the gas turbine combustor internal cylinder 20 and flow the premixed gas spirally in the circumferential direction. Therefore, the premixed gas is further mixed in the process of spirally flowing around the diffusion flame, and homogeneously burns in the whole area within the combustion chamber 50. Based on the mutual interaction, it is possible to sufficiently suppress the generation of a local high-temperature area, and therefore, it is possible to sufficiently suppress the generation of $NO_x$.

In the fuel injection nozzle 600 according to the present invention, the hollow spokes 62 have aerofoil cross sections. Therefore, the combustion air flows smoothly along the surface of the hollow spokes 62, which suppresses the disturbance of the combustion air at the downstream of the hollow spoke 62. Therefore, it is possible to suppress backfire attributable to the disturbance of the combustion air. Further, based on the outward spiral flow, the recirculation area formed at the center portion of the gas turbine combustor expands. Based on the interaction, the combustion of the premixed flame becomes stable, and it becomes possible to suppress the combustion oscillation. Therefore, it is possible to carry out a stable operation of the gas turbine. As the premixed gas burns in the whole area within the combustion chamber 50, there remains little premixed gas that does not combust, which makes it possible to efficiently utilize the fuel. In the present embodiment, in order to provide the outward spiral flow, only the outlet of each nozzle extension pipe 410 is inclined toward the outside of the radial direction and the circumferential direction of the gas turbine combustor internal cylinder 20. Since it is not necessary to carry out a special processing to the exit of each nozzle extension pipe 410, it becomes easy to manufacture the nozzle extension pipe.

Figure 13:
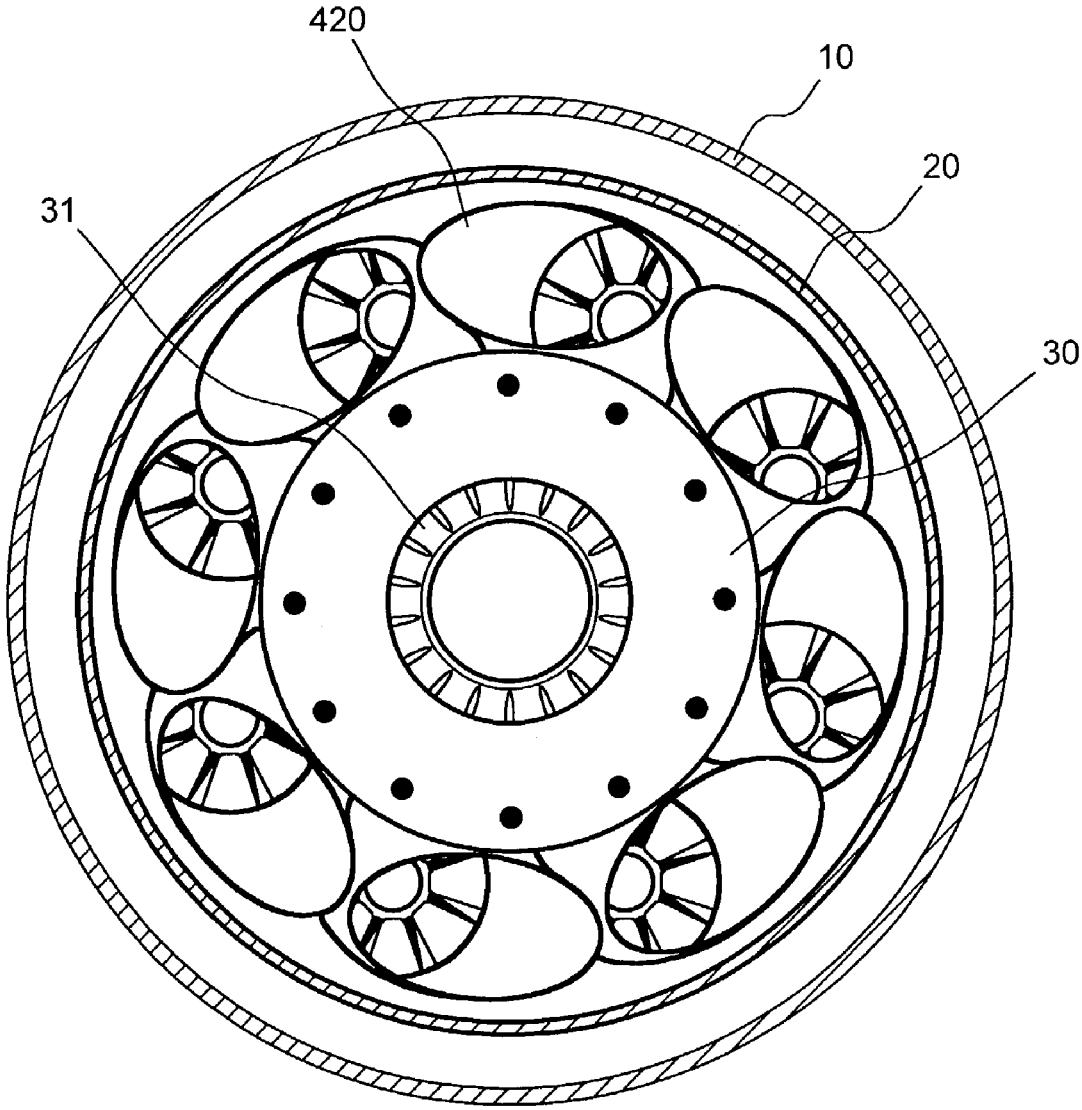
FIG. 13 is a front view of the gas turbine combustor as a first modification of the first application example.

A first modification of the first application example is explained below. FIG. 13 is a front view of the gas turbine combustor as a first modification of the first application example. While the outlet of each nozzle extension pipe 410 (see FIG. 7) has a sector shape in the gas turbine combustor according to the first application example, the outlet of each nozzle extension pipe 420 may have an elliptical shape as shown in this modification. Based on this arrangement, the premixed gas injected from the nozzle extension pipes 420 also forms an outward spiral flow. Therefore, the premixed gas of which fuel is sufficiently diffused by the fuel injection nozzle 600 combusts in the whole area in the combustion chamber, not shown. Consequently, the generation of a local high-temperature area is reduced, and it becomes possible to suppress the generation of $NO_x$. In the present modification, the outlet of each nozzle extension pipe 420 may have a circular shape.

Figure 14:
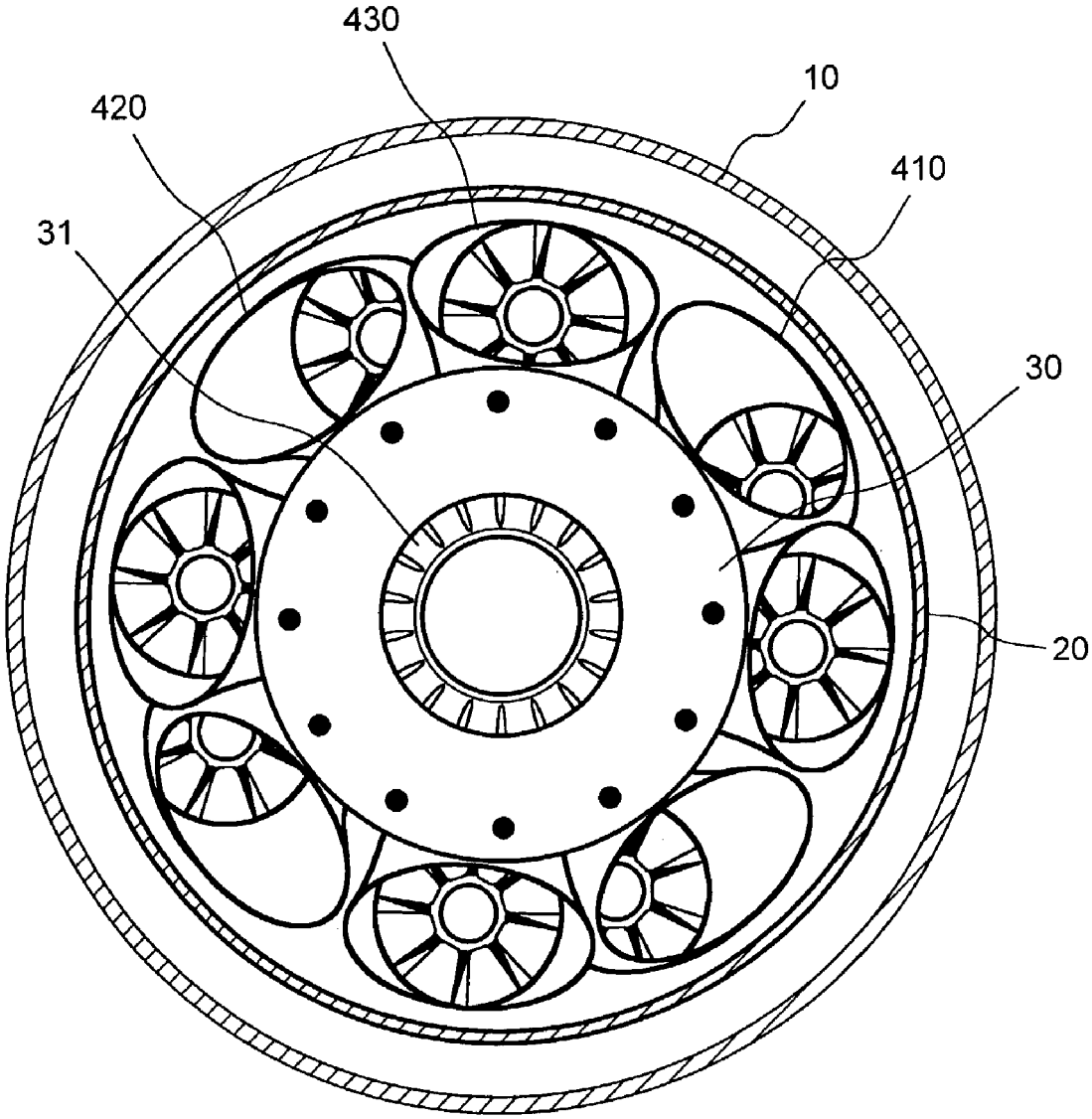
FIG. 14 is a front view of the gas turbine combustor as a second modification of the first application example.

FIG. 14 is a front view of the gas turbine combustor as a second modification of the first application example. As shown in this modification, an outward nozzle extension pipe 430 and the nozzle extension pipe 420 that forms an outward spiral flow may be disposed alternately. With this arrangement, an outward straight flow of the premixed gas according to the nozzle extension pipe 430 and an outward spiral flow of the premixed gas according to the nozzle extension pipe 420 collide each other. The premixed gas whose fuel is sufficiently diffused by the fuel injection nozzle 600 is further mixed. Consequently, the generation of a local high-temperature area is reduced, and it becomes possible to more suppress the generation of $NO_x$. The shape of each exit of the nozzle extension pipes 430 and 420 is not limited to the elliptical shape as shown in FIG. 13 and FIG. 14, and it is also possible to take a circular shape, or a sector shape as shown in FIG. 8.

Figure 15:
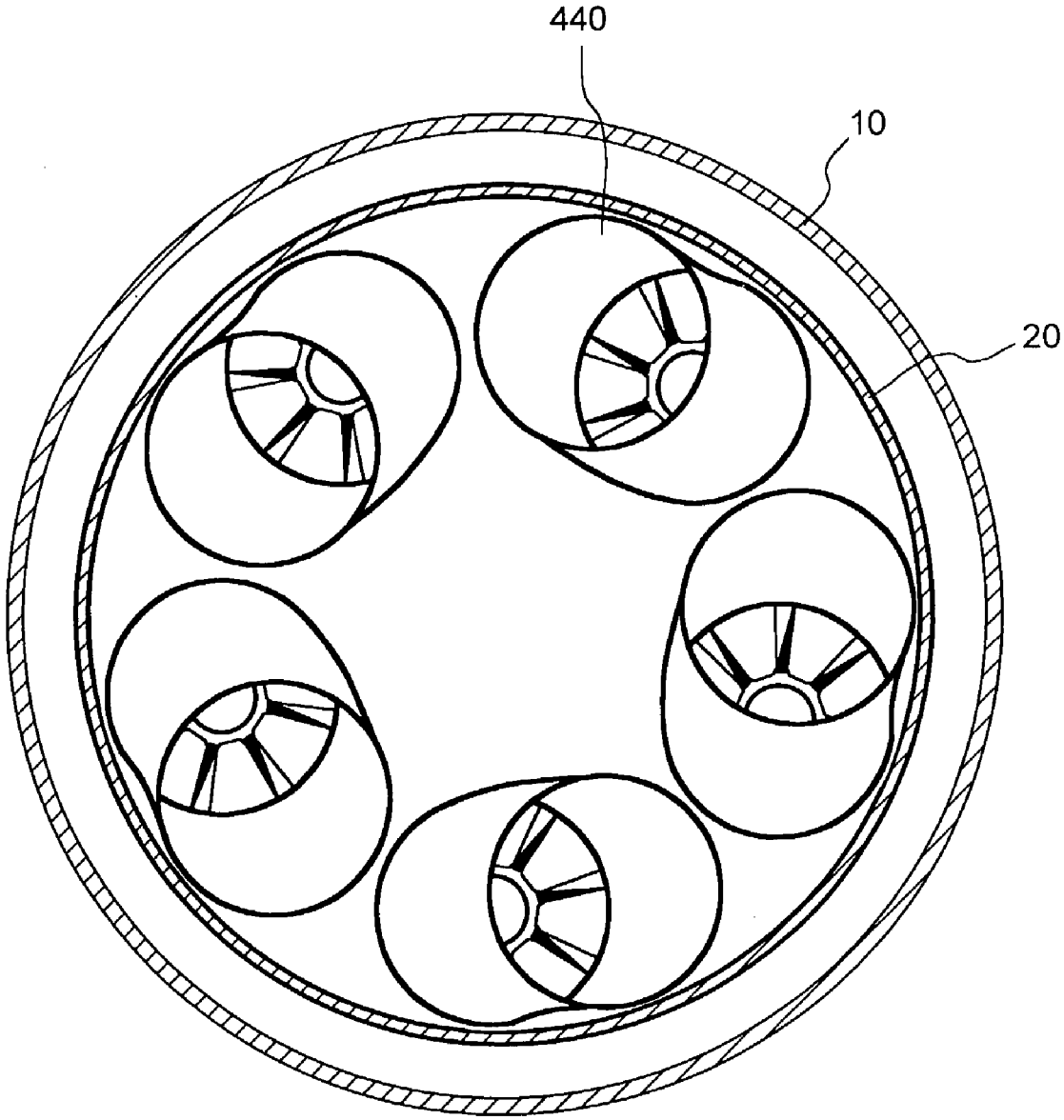
FIG. 15 is a front view of the fuel injection nozzle according to the present invention that is applied to the gas turbine combustor as the second application example.
Figure 16:
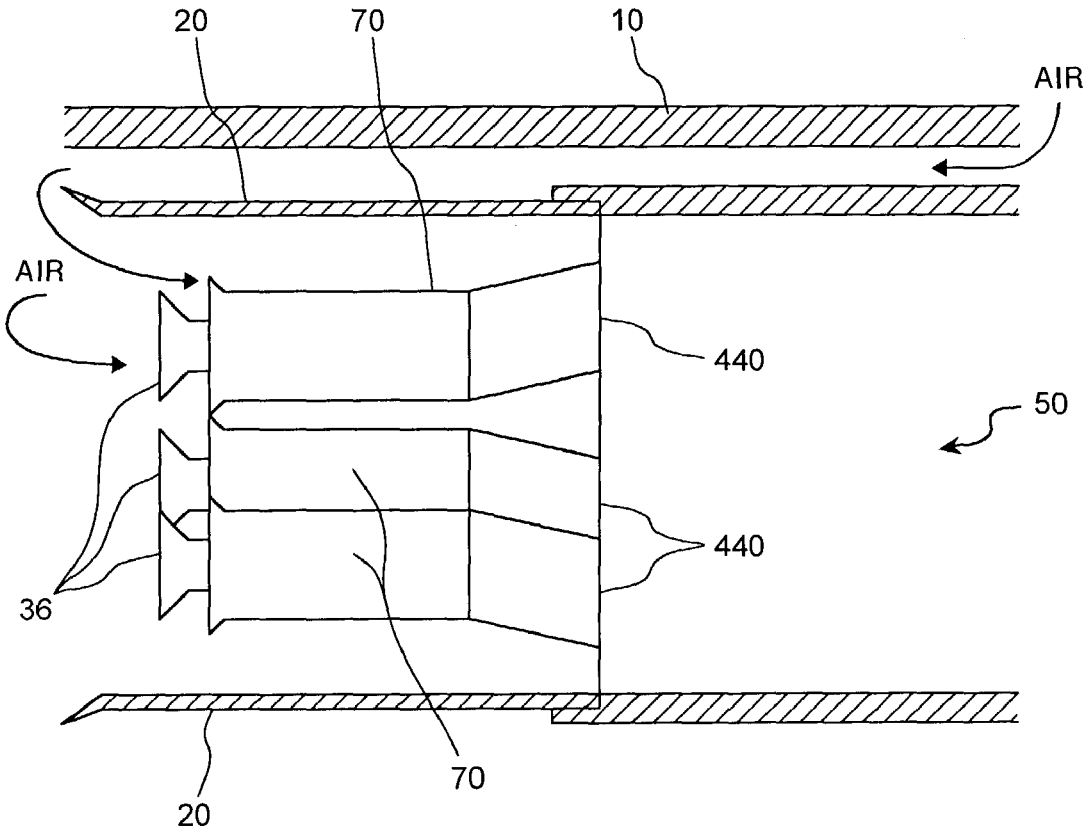
FIG. 16 is a cross-sectional view in an axial direction of the gas turbine combustor shown in FIG. 15.
Figure 17:
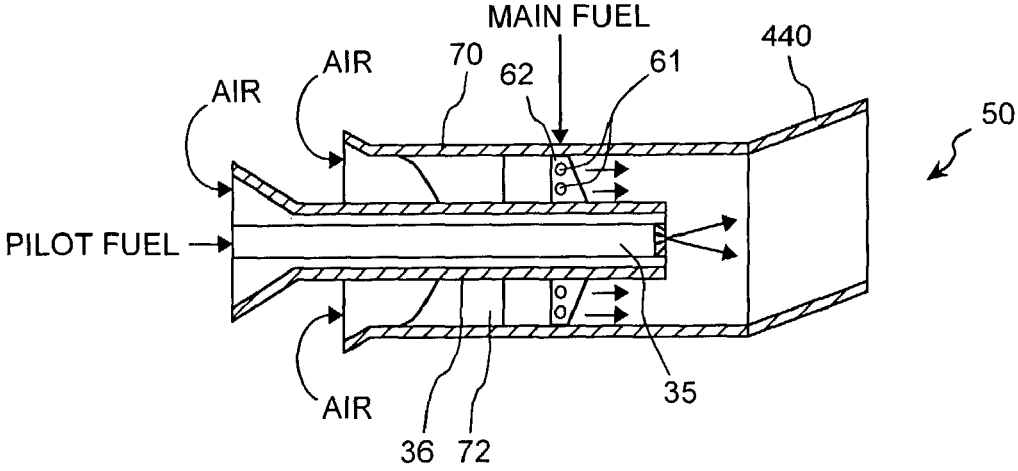
FIG. 17 is a cross-sectional view in an axial direction of a mixed gas formation cylinder used in the gas turbine combustor according to the second application example.

FIG. 15 is a front view of the fuel injection nozzle according to the present invention that is applied to the gas turbine combustor as the second application example. FIG. 16 is a cross-sectional view in an axial direction of the gas turbine combustor shown in FIG. 15. FIG. 17 is a cross-sectional view in an axial direction of a mixed gas formation cylinder that is used in the gas turbine combustor according to the second application example. The gas turbine combustor includes, inside each mixed gas formation cylinder 70, the hollow spokes 62 having the fuel injection holes 61 that inject the main fuel, and a pilot nozzle 36. The mixed gas formation cylinders 70 are disposed annularly inside the gas turbine combustor internal cylinder 20.

As shown in FIG. 17, each mixed gas formation cylinder 70 used in the second application example includes the hollow spokes 62 and the pilot nozzle 36 having a pilot fuel injection nozzle 35 inside. A swirler 72 is provided at the combustion air intake side of each mixed gas formation cylinder 70. The swirler 72 gives a swirl to the combustion air, and sufficiently mixes the main fuel with the pilot fuel.

Nozzle extension pipes 440 are provided at the outlet of each mixed gas formation cylinder 70. Each nozzle extension pipe 440 injects a gas mixture of the combustion air, the main fuel, and the pilot fuel to the combustion chamber 50 side. The outlet of each nozzle extension pipe 440 has a circular shape, and is inclined toward the outside of the radial direction of the gas turbine combustor internal cylinder 20. The nozzle extension pipe 440 is also inclined toward the circumferential direction of the gas turbine combustor internal cylinder 20. The outlet of each nozzle extension pipe 440 is not limited to the circular shape, and it may be a sector shape or an elliptical shape as shown in the first embodiment. This similarly applies to the following explanation.

The gas turbine combustor in the second application example has five mixed gas formation cylinders 70, each having the nozzle extension pipe 440 at the outlet thereof, disposed annularly inside the gas turbine combustor internal cylinder 20 (see FIG. 15 and FIG. 16). The number of the mixed gas formation cylinders 70 is not limited to five, and it is possible to suitably increase or decrease the number according to the specifications of the gas turbine combustor.

The flow of air is explained with reference to FIG. 16. The combustion air sent from a compressor, not shown, is guided into the gas turbine combustor external cylinder 10. The combustion air passes through between the gas turbine combustor external cylinder 10 and the gas turbine combustor internal cylinder 20, and changes the flow direction by 180 degrees. Then, the combustion air is sent from behind the mixed gas formation cylinders 70 into the pilot nozzles 36 and into the mixed gas formation cylinders 70.

The flow is explained with reference to FIG. 17 next. The combustion air guided into each pilot nozzle 36 is sufficiently mixed with the pilot fuel injected from the pilot fuel injection nozzle 35. The swirler 72 provided within the mixed gas formation cylinder 70 stirs the combustion air guided into the mixed gas formation cylinder 70. The combustion air is sufficiently mixed with the main fuel injected from the fuel injection holes 61 provided on the hollow spokes 62, thereby to form the premixed gas. Since the fuel injection holes 61 are provided with a distance from the surface of the pilot nozzle 36, the main fuel sufficiently diffuses to the combustion air, and is mixed with the combustion air. Since it is necessary to suppress the generation of $NO_x$, the premixed gas is in a state that air is excess for the fuel.

The mixed gas of the pilot fuel and the combustion air, and the premixed gas are injected to the combustion chamber 50 side via the nozzle extension pipes 440. The mixed gas of the pilot fuel that is injected to the combustion chamber 50 side and the combustion air forms a diffusion flame. The high-temperature combustion gas generated from the diffusion flame causes the premixed gas to be combusted quickly. This diffusion flame stabilizes the combustion of the premixed gas, and suppresses backfire of the premixed flame and autoignition of the premixed gas. The combusted premixed gas forms a premixed flame, and the high-temperature and high-pressure combustion gas is emitted from the premixed flame.

The mixed gas of the pilot fuel and the combustion air, and the premixed gas is directed from the nozzle extension pipes 440 toward the outside of the radial direction of the gas turbine combustor internal cylinder 20, and becomes the outward spiral flow that swirls to the circumferential direction and flows into the combustion chamber 50. Based on this outward spiral flow, the premixed gas is mixed sufficiently, and the combustion progresses in the whole area in the gas turbine combustor. Since the hollow spokes 62 diffuse the main fuel of the premixed gas, based on the interaction with the mixing operation, it is possible to more suppress the generation of a local high-temperature area. Therefore, it is possible to suppress the generation of $NO_x$.

Based on the outward spiral flow, a portion near the inner wall of the combustion chamber 50 is applied with a high pressure, and a portion near the center is applied with a low pressure. As a result, a circular flow is generated between the vicinity of the inner wall and the vicinity of the center, and a recirculation area is formed. As the cross section of each hollow spoke 62 is aerofoil, the combustion air flows smoothly, and it becomes possible to suppress the generation of backfire. Based on these actions, the flame is stabilized and the combustion oscillation is reduced. Therefore, it is possible to carry out a stable operation of the gas turbine.

Figure 18:
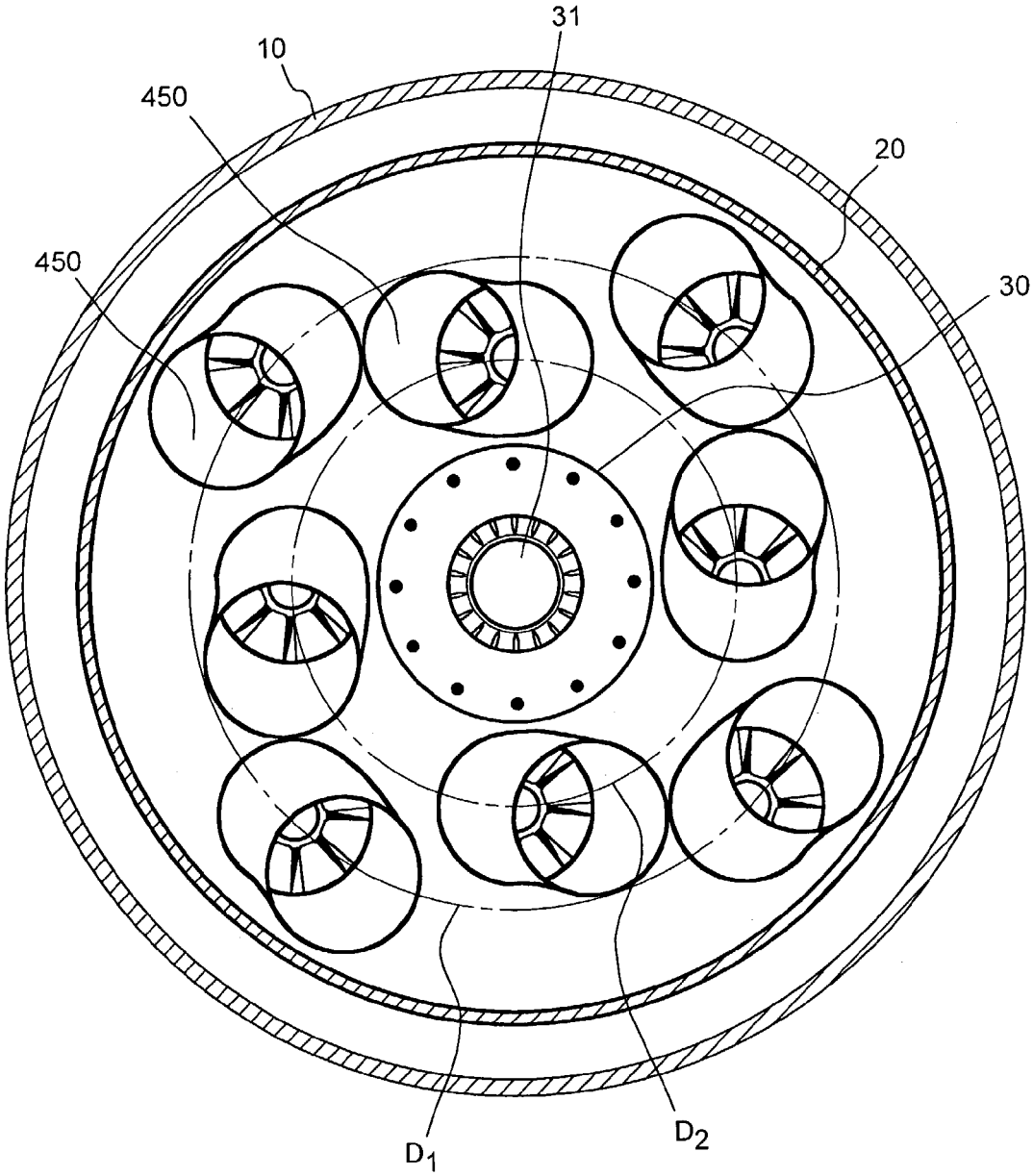
FIG. 18 is a front view of the fuel injection nozzle according to the present invention that is applied to the gas turbine combustor as the third application example.

FIG. 18 is a front view of the fuel injection nozzle according to the present invention that is applied to the gas turbine combustor as the third application example. In the gas turbine combustor according to the present application example, a plurality of premix nozzles are disposed on pitch circles $D_1$ and $D_2$ ($D_1>D_2$) having different sizes that exist on a plane perpendicular to an axial direction of the gas turbine combustor internal cylinder 20.

As shown in FIG. 18, in the gas turbine combustor according to the third application example, the corn 30 that forms a diffusion combustion flame is provided inside the gas turbine combustor internal cylinder 20. Around the corn 30, a plurality of premixed flame formation nozzles, not shown, are disposed on at least two pitch circles having different sizes. Four premixed flame formation nozzles are disposed on each of the pitch circles $D_1$ and $D_2$. The number of the premixed flame formation nozzles is not limited to four.

Each premixed flame formation nozzle has the fuel injection nozzle 600 (refer to FIGS. 1A to 1C) that injects the main fuel, inside thereof. The fuel injection nozzle 600 injects the main fuel from the fuel injection holes 61 provided on the hollow spokes 62, and sufficiently diffuses the main fuel to the combustion air (see FIGS. 1A to 1C). A nozzle extension pipe 450 is provided at the outlet of each premixed flame formation nozzle. The nozzle extension pipe 450 injects the premixed gas that is the mixture of the combustion air and the main fuel, to the combustion chamber side, not shown. The outlet of each nozzle extension pipe 450 has a circular shape, and the outlet is inclined toward the outside of a radial direction of the gas turbine combustor internal cylinder 20. At the same time, the nozzle extension pipe 450 is also inclined toward the circumferential direction of the gas turbine combustor internal cylinder 20.

The premixed gas injected from the premixed flame formation nozzle is injected to the combustion chamber side via the nozzle extension pipe 450. Based on the nozzle extension pipe 450, the premixed gas injected to the combustion chamber side becomes an outward spiral flow, and flows spirally within the combustion chamber. In the gas turbine combustor according to the present application example, since the premixed flame formation nozzles are disposed on each of the two pitch circles $D_1$ and $D_2$, the outward spiral flow is generated corresponding to the respective groups of the premixed flame formation nozzles provided on each of the two pitch circles $D_1$ and $D_2$. Based on the two outward spiral flows, a circulation flow is generated between the vicinity of the inner wall of the combustion chamber and the vicinity of the center of the combustion chamber, and between the outward spiral flow according to the outside premixed flame formation nozzle group and the outward spiral flow according to the inside premixed flame formation nozzle group, respectively. Based on the outward spiral flows and the circulation flows, the premixed gas of which main fuel is sufficiently diffused by the fuel injection nozzles 600 is further mixed. As a result, it is possible to suppress the generation of a local high-temperature portion, and therefore, it is possible to further suppress the generation of $NO_x$.

Since the cross section of each hollow spoke 62 provided on the fuel injection nozzle 600 is aerofoil, the combustion air flows smoothly at the back of the hollow spoke 62. Based on this action and the two recirculation areas, the premixed flame is more stabilized, and it becomes possible to reduce combustion oscillation and the like. In the gas turbine combustor according to the present embodiment, as the premixed flame formation nozzles are disposed on each of the two pitch circles $D_1$ and $D_2$, it is possible to suitably select the premixed flame formation nozzle group according to the load. Therefore, it is possible to carry out a lean combustion operation at an optimum fuel-to-air ratio in a whole range from a partial load to the full load. Consequently, it is possible to suppress the generation of $NO_x$ in the whole load areas.

Figure 19:
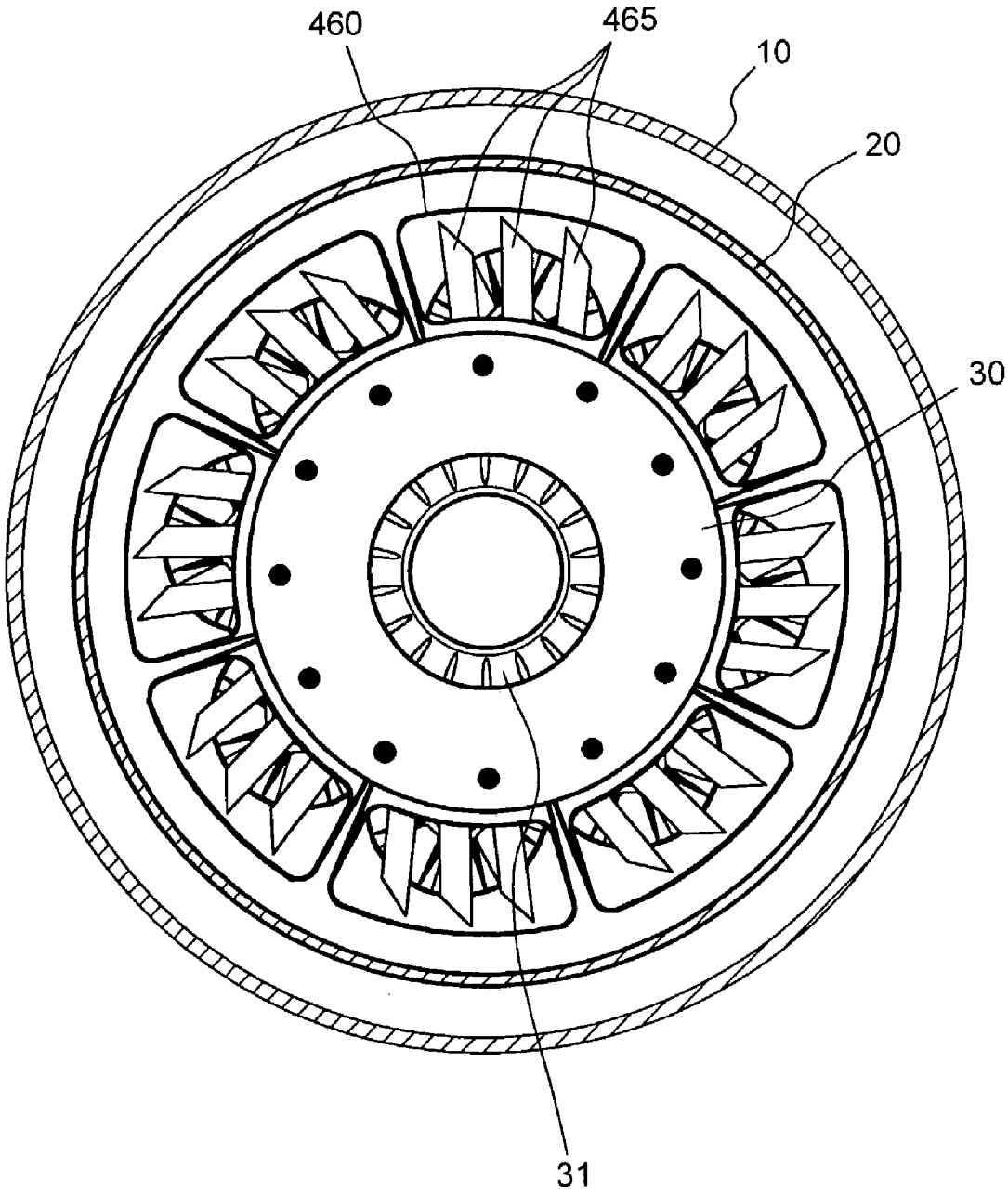
FIG. 19 is a front view of the fuel injection nozzle according to the present invention that is applied to a gas turbine combustor as a fourth application example.
Figure 20:
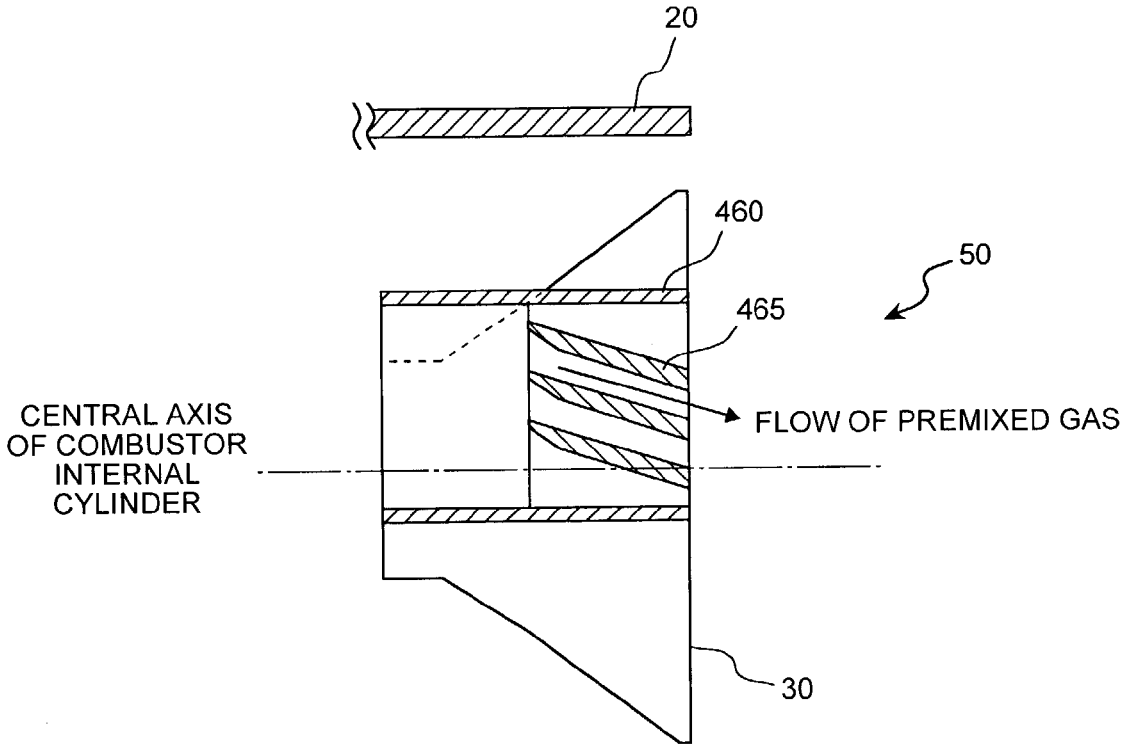
FIG. 20 is a cross-sectional view in an axial direction of a nozzle extension pipe used in the gas turbine combustor according to the fourth application example.

FIG. 19 is a front view of the fuel injection nozzle according to the present invention that is applied to a gas turbine combustor as a fourth application example. FIG. 20 is a cross-sectional view in an axial direction of a nozzle extension pipe that is used in the gas turbine combustor according to the fourth application example. This gas turbine combustor adjusts the direction of the premixed gas with fins provided within each nozzle extension pipe 460.

As shown in FIG. 19 and FIG. 20, the exit of each nozzle extension pipe 460 is inclined toward the inner wall of the gas turbine combustor internal cylinder 20. The nozzle extension pipe 460 gives an outward flow to the fuel injection nozzle based on this inclination. In the vicinity of the outlet of each nozzle extension pipe 460, fins 465 are provided to give the premixed gas a swirl that is directed toward the circumferential direction of the gas turbine combustor internal cylinder 20. It is possible to suitably increase or decrease the number of the fins 465. The fins 465 may be provided on the inner wall of the gas turbine combustor internal cylinder 20. In this case, the fins 465 are disposed nearer to the combustion chamber, not shown, and are disposed to a high temperature. Therefore, it is preferable to cool the fins 465 with a cooling unit such as a film cooling or a convection cooling.

The gas turbine combustor according to the fourth application example has the fins 465 provided at the outlet of the nozzle extension pipes 460. The outlet of each nozzle extension pipe 460 is inclined toward the outside of the radial direction of the gas turbine combustor internal cylinder 20. The fuel injection nozzle 600 (see FIGS. 1A to 1C) provided on each premixed flame formation nozzle diffuses the main fuel to the combustion air. The premixed gas that includes a sufficient mixture of the main fuel injected from the nozzle extension pipe 460 flows spirally around the axis of the gas turbine combustor internal cylinder 20, and becomes what is called the outward spiral flow. The premixed gas is further sufficiently mixed based on the outward spiral flow. Consequently, it is possible to reduce the generation of a local high-temperature area, and therefore, it is possible to further suppress the generation of $NO_x$.

As the cross section of each hollow spoke 62 provided on the fuel injection nozzle 600 is aerofoil, the premixed gas is injected smoothly from the nozzle extension pipe 460. Based on the outward spiral flow, a portion near the inner wall of the combustion chamber 50 is applied with a high pressure, and a portion near the center is applied with a low pressure. Therefore, a large circulation flow is generated between the vicinity of the inner wall and the vicinity of the center, thereby to expand a recirculation area. As the premixed gas combusts stably based on these actions, it is possible to suppress the combustion oscillation and the like, and it becomes possible to carry out a stable operation of the gas turbine. When the fins 465 are provided on the inner wall of the gas turbine combustor internal cylinder 20, it is also possible to obtain a similar effect.

Figure 21:
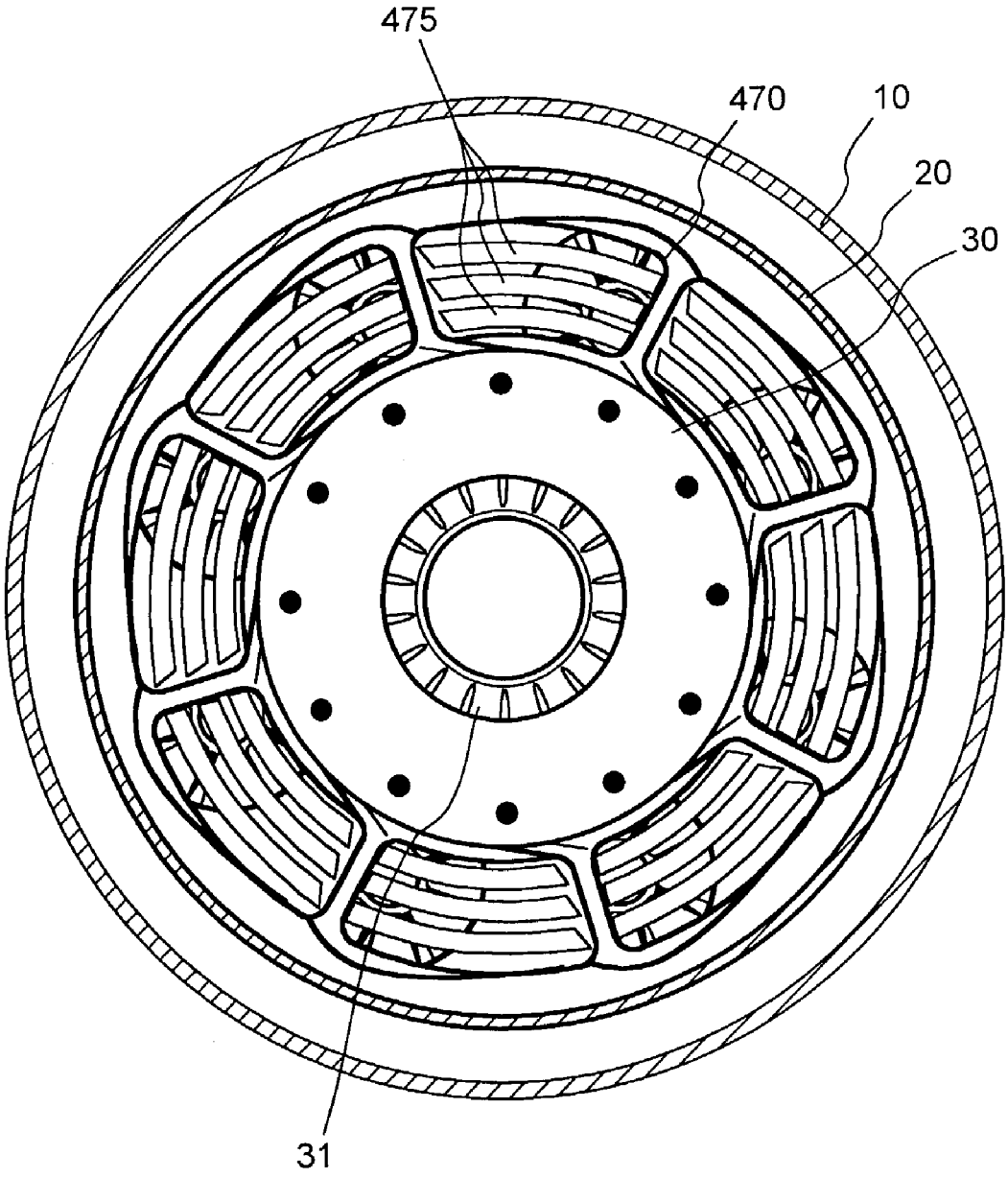
FIG. 21 is a front view of the gas turbine combustor as a modification of the fourth application example.
Figure 22:
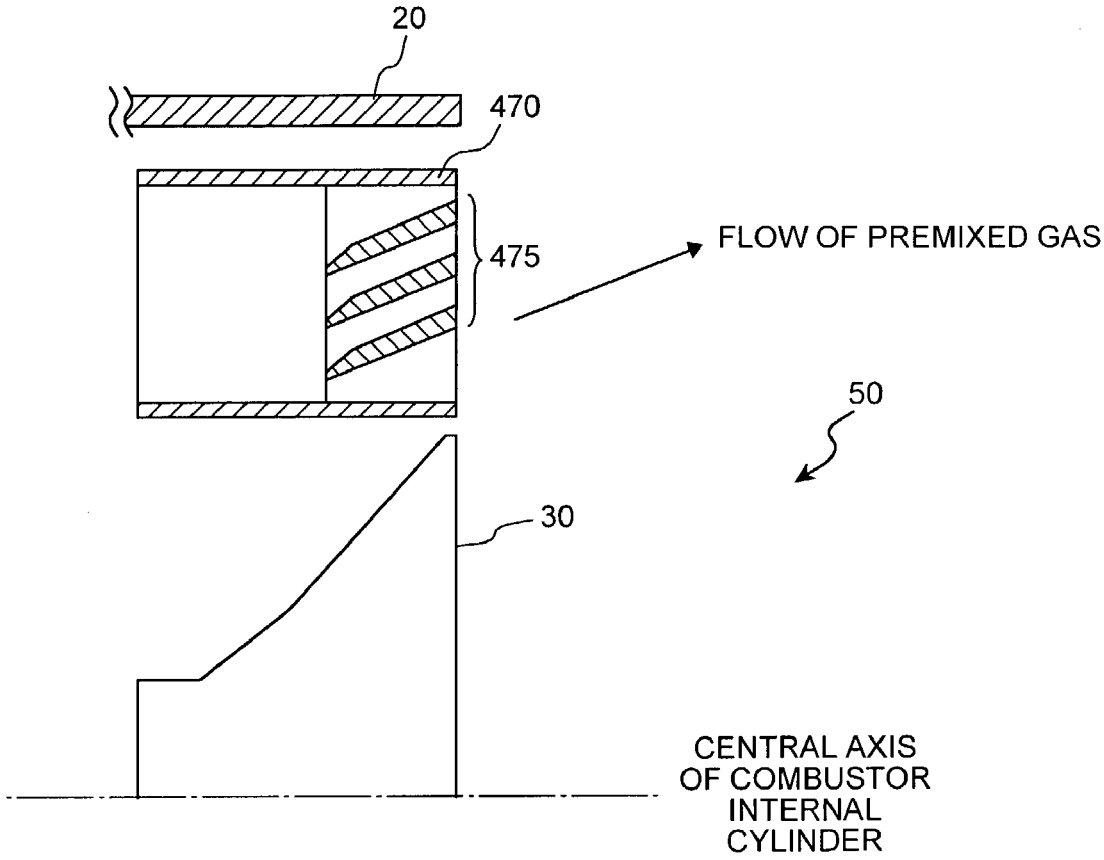
FIG. 22 is a cross-sectional view in an axial direction of a premixed flame formation nozzle extension pipe used in the modification shown in FIG. 21.

FIG. 21 is a front view of the gas turbine combustor as a modification of the fourth application example. FIG. 22 is a cross-sectional view in an axial direction of a premixed flame formation nozzle extension pipe that is used in this modification. While the gas turbine combustor described above gives a swirl to the premixed gas with the fins 465, a gas turbine combustor according to the present modification gives an outward flow to the premixed gas with fins 475, and gives a swirl to the premixed gas based on an inclination of the nozzle extension pipes.

In the gas turbine combustor according to the present modification, the fins 475 are provided at the outlet of each nozzle extension pipe 470. The outlet of the nozzle extension pipe 470 is inclined to give the premixed gas a swirl that is directed to the circumferential direction of the gas turbine combustor internal cylinder 20. The fins 475 are also inclined toward the outside of the radial direction of the gas turbine combustor internal cylinder 20, thereby to give the premixed gas a flow directed to this direction. It is possible to suitably increase or decrease the number of fins 475.

Based on the inclination of the nozzle extension pipes 470 and the inclination of the fins, the premixed gas injected from the nozzle extension pipes 470 proceeds spirally around the axis of the gas turbine combustor internal cylinder 20. In other words, the premixed gas forms the outward spiral flow. Since the premixed gas is sufficiently mixed based on the outward spiral flow and the fuel injection nozzles 600 (see FIGS. 1A to 1C), it is possible to reduce the generation of a local high-temperature area, and it is possible to suppress the generation of $NO_x$. Based on the outward spiral flow, a portion near the inner wall of the combustion chamber 50 is applied with a high pressure, and a portion near the center is applied with a low pressure. Therefore, a circulation flow is generated between the inner wall of the combustion chamber 50 and the center, thereby to form a recirculation area. The recirculation area and the fuel injection nozzles 600 (see FIGS. 1A to 1C) cause the combustion air to flow smoothly, and diffuse the main fuel. Based on these actions, the premixed flame is formed stably. As a result, it is possible to reduce the combustion oscillation and the like, and it is possible to carry out a more stable operation of the gas turbine.

Figure 23:
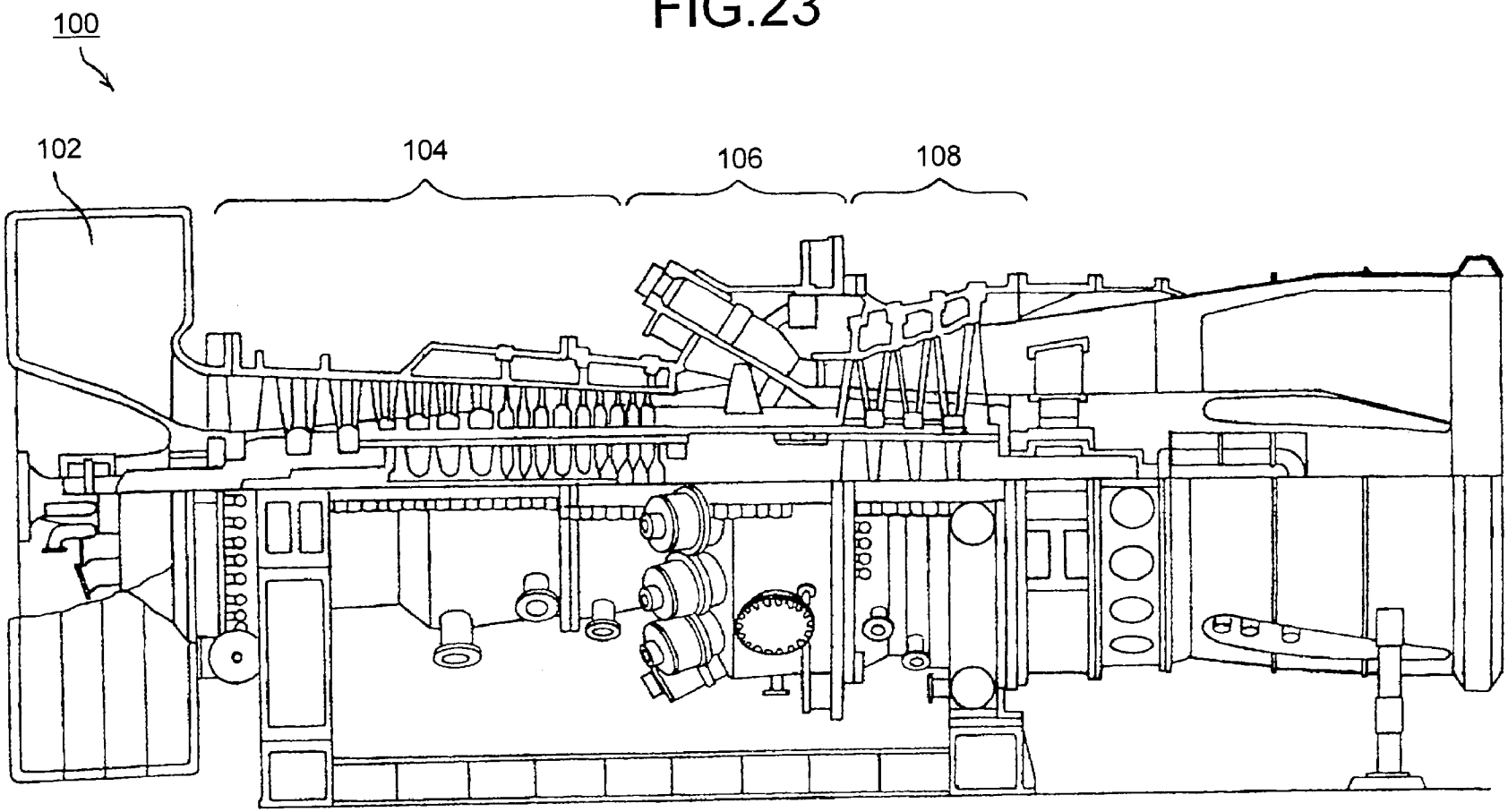
FIG. 23 explains about a gas turbine that includes the fuel injection nozzles for the gas turbine combustor according to the present invention.
Figure 24:
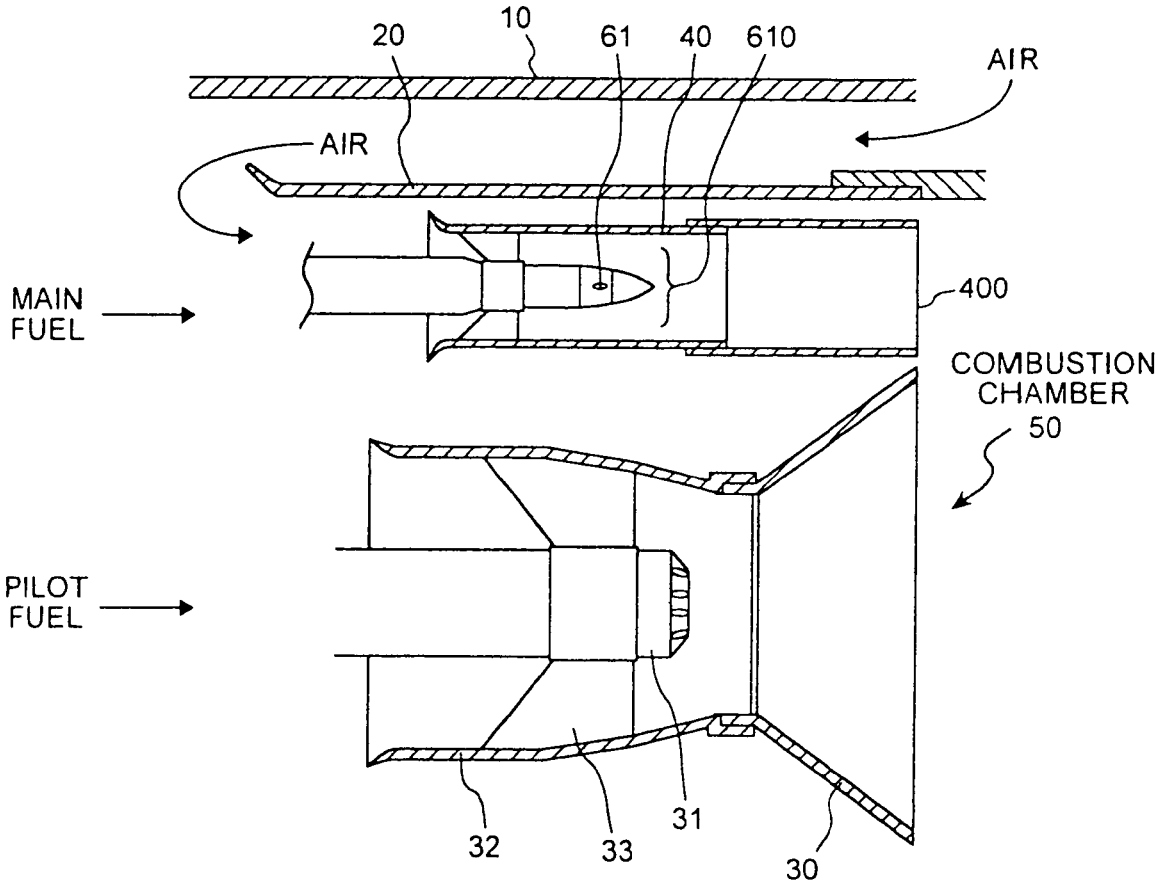
FIG.24 PRIOR ART
FIG. 24 is a cross-sectional view in an axial direction of a gas turbine combustor based on the premixed system as one example.
Figure 25A:
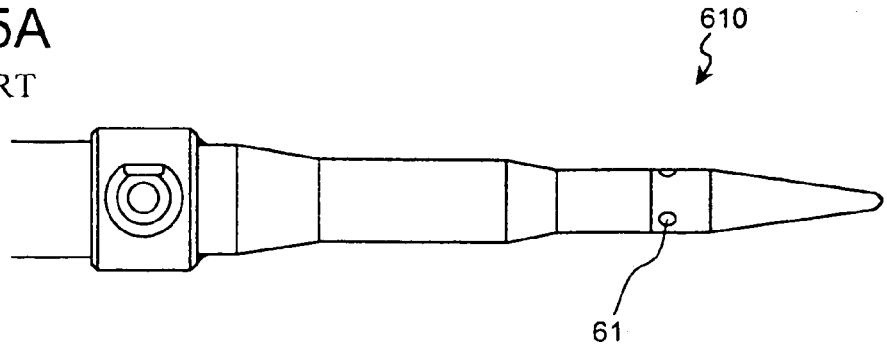
FIG.25A PRIOR ART
FIGS. 25A and 25B are diagrams to explain about a main fuel injection nozzle for the gas turbine combustor based on the premixed system used conventionally.
Figure 25B:
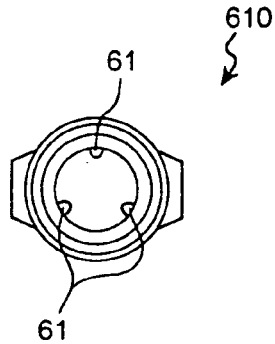
FIG.25B PRIOR ART
Figure 26A:
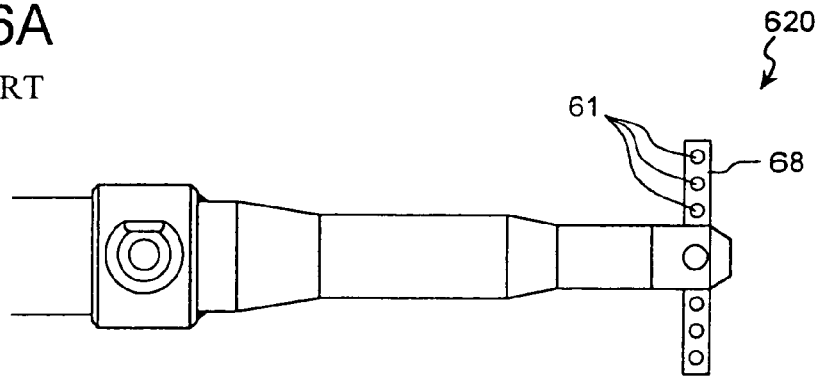
FIG.26A PRIOR ART
FIG. 26A and FIG. 26B are diagrams to explain about a fuel injection nozzle according to the prior art.
Figure 26B:
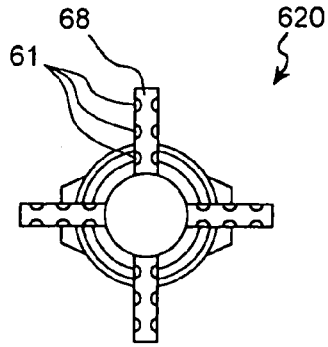
FIG.26B PRIOR ART

FIG. 23 is a diagram to explain about a gas turbine that comprises the fuel injection nozzles for a gas turbine combustor according to the present invention. The gas turbine combustor having the fuel injection nozzles for the gas turbine combustor are applied to a gas turbine combustor 106 that is provided in a gas turbine 100. A compressor 104 compresses the air taken in from an air intake opening 102. The air becomes high-temperature and high-pressure compressed air, and is sent to the gas turbine combustor 106. The gas turbine combustor 106 supplies a gas fuel such as natural gas or a liquid fuel such as gas oil or light heavy fuel to the compressed air, and burns the fuel, thereby to generate high-temperature and high-pressure combustion gas as a working fluid. The gas turbine combustor 106 injects the high-temperature and high-pressure combustion gas to a turbine 108. The combustion gas drives the turbine 108, and is then emitted to the outside of the gas turbine 100.

Although not clear from FIG. 23, the gas turbine combustor 106 comprises the fuel injection nozzles 600 and the like according to the present invention. Therefore, the fuel can diffuse easily at the downstream of the hollow spokes 62 and the like (see FIGS. 1A to 1C) provided at the fuel injection nozzle 600 and the like. Consequently, the mixed gas of the fuel and the combustion air burns homogeneously, and it is possible to suppress the generation of a local high-temperature area. As a result, the gas turbine 100 can reduce the generation of $NO_x$ more than the conventional gas turbine. When the cross section of each hollow spoke is aerofoil, the combustion air can flow more smoothly. Since disturbance of the combustion air is reduced at the back of the hollow spoke, it is possible to suppress backfire while sufficiently diffusing the fuel. Consequently, it is possible to reduce the burnout of the nozzle extension pipe and the like, and it is possible to make long the life of the gas turbine combustor 106 of the gas turbine 100. It is also possible to reduce the trouble of maintenance and inspection. Since it is possible to stably combust the fuel, it becomes possible to carry out a highly reliable operation.

When the hollow spokes inclined toward the flow direction of the combustion air are used, it is possible to give a swirl to the combustion air. Therefore, it is possible to sufficiently mix the fuel with the combustion air at the downstream of the hollow spokes. Since it is possible to suppress the generation of a local high-temperature area, the gas turbine 100 can reduce the generation of $NO_x$ more than the conventional gas turbine. Since the gas turbine can suppress the generation of backfire more than the conventional gas turbine, it is possible to carry out a highly reliable operation by maintaining a stable combustion state. Since it is possible to make long the life of the gas turbine combustor 106, it becomes possible to reduce the trouble of maintenance and inspection.

When the premixed flame formation nozzles 40*b* shown in FIG. 10 are used, it is possible to suppress the interference of air that flows into the premixed flame formation nozzles 40*b* according to the hollow spokes 62. Since it becomes possible to supply sufficient quantity of air to the premixed flame formation nozzles 40*b*, it is possible to reduce the generation quantity of $NO_x$. When the trailing edge 62*t* of the hollow spoke 62 has the sweptforward angle θ as shown in FIG. 10, air flows smoothly along the trailing edge 62*t*. Therefore, it is possible to suppress the generation of backfire, and it becomes possible to suppress the burnout of the premixed flame formation nozzles 40*b*. Consequently, it is possible to make long the life of the premixed flame formation nozzles 40*b*, and it becomes possible to reduce the trouble of maintenance and inspection.

In the present gas turbine 100, it is possible to apply the fuel injection nozzles 600 and the like (see FIGS. 1A to 1C) according to this invention to the diffusion flame formation nozzles, not shown, provided in the gas turbine combustor 106. Based on this, the fuel can diffuse easily at the downstream of the hollow spokes, and the combustion air and the fuel are mixed homogeneously. Thus, it becomes possible to burn the mixed gas homogeneously. Since it is possible to reduce the generation of a local high-temperature area, the gas turbine combustor 100 can reduce the generation quantity of $NO_x$ more than the conventional gas turbine.

As explained above, according to a first aspect of the present invention, in the fuel injection nozzle for a gas turbine combustor, a plurality of fuel injection holes that supply fuel are provided on the side surfaces of the hollow spokes, each having an aerofoil cross section, with a distance from the surface of the nozzle body. Therefore, the fuel can easily diffuse at the downstream of the hollow spokes. The mixed gas of the fuel and the combustion air burns homogeneously, which can suppress the generation of a local high-temperature area. As a result, this fuel injection nozzle can reduce the generation of $NO_x$ more than the conventional fuel injection nozzle. Since the cross section of each hollow spoke according to the present invention is aerofoil, the combustion air flows smoothly. Therefore, it is possible to reduce the disturbance of the combustion air at the back of the hollow spoke, and it becomes possible to suppress backfire while reducing the generation of $NO_x$.

According to a second aspect of the present invention, the fuel injection nozzle for a gas turbine combustor has the hollow spokes disposed at the upstream of the swirler. Therefore, the swirler disposed at the downstream of the hollow spokes generates pressure loss in the combustion gas. This pressure loss stirs the combustion gas, and homogeneously mixes the fuel in the combustion gas with air, therefore, the combustion air combusts more homogeneously. As a result, it becomes possible to more suppress the generation of a local high-temperature area, and it becomes possible to more reduce $NO_x$.

According to a third aspect of the present invention, in the fuel injection nozzle for a gas turbine combustor, the trailing edge of the end portion of each hollow spoke is disposed at the upstream of the inlet of the flame formation nozzle. Therefore, it is possible to minimize the influence of the hollow spoke, and it is possible to supply a sufficient quantity of combustion air into the flame formation nozzle. As a result, it becomes possible to reduce the generation of $NO_x$.

According to a fourth aspect of the present invention, in the fuel injection nozzle for a gas turbine combustor, a fuel injection nozzle consisting of only hollow spokes is provided on the inner wall of the flame formation nozzle. Therefore, the cylindrical nozzle body is not necessary. The cross sectional area through which the combustion air passes inside the flame formation nozzle can be made larger than that when the fuel injection nozzle having the cylindrical nozzle body is used. Consequently, when the quantities of the combustion air that flow in both cases are the same, it is possible to make smaller the external sizes of the flame formation nozzle. As a result, it becomes possible to suppress backfire while reducing the generation of $NO_x$, and it becomes possible to make compact the gas turbine combustor as a whole.

According to a fifth aspect of the present invention, the fuel injection nozzle for a gas turbine combustor has the hollow spokes inclined toward the flow direction of the combustion air. Since it is possible to give a swirl to the combustion air, it becomes possible to sufficiently mix the fuel with the combustion air based on the interaction with the diffusion of fuel. Since each hollow spoke has an aerofoil cross section, there is little separation of the combustion air, and it becomes possible to suppress disturbance of the flow at the downstream of the hollow spokes. As a result, it is possible to suppress the generation of a local high-temperature area, and it is possible to suppress backfire while reducing the generation of $NO_x$.

According to a sixth aspect of the present invention, the fuel injection nozzle for a gas turbine combustor has the sweptforward angle at the trailing edge of each hollow spoke. Therefore, the combustion air that enters from the leading edge flows smoothly along the trailing edge. As a result, it is possible to suppress disturbance of the flow at the downstream of the hollow spokes, and it becomes possible to suppress backfire.

According to a seventh aspect of the present invention, the gas turbine combustor has the fuel injection nozzle for a gas turbine combustor. Therefore, it is possible to suppress the generation of $NO_x$, and it becomes possible to reduce the environmental burden by purifying exhaust gas. Since the fuel injection nozzle for the gas turbine combustor can suppress backfire, the life of the gas turbine combustor becomes long, and it becomes possible to reduce the trouble of maintenance and inspection.

According to an eighth aspect of the present invention, the gas turbine has a gas turbine combustor having the fuel injection nozzle for a gas turbine combustor. Therefore, it is possible to reduce $NO_x$, and it becomes possible to reduce the environmental burden by purifying exhaust gas. Since it is also possible to suppress the generation of backfire, it becomes possible to carry out a highly reliable operation by maintaining a stable combustion state.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A fuel injection nozzle for a gas turbine combustor comprising:
- a nozzle body that has a first cavity where fuel flows; and
- a spoke that is provided on the nozzle body and has
  - a leading edge,
  - a trailing edge forming a sweptforward angle of 10 to 30 degrees,
  - a second cavity connected to the first cavity, and
  - a hole from which the fuel is injected,
  - wherein the hole is provided on a side of the spoke at a distance from a surface of the nozzle body, and the distance is determined based on diffusion of the fuel.

2. The fuel injection nozzle for a gas turbine combustor according to claim 1, wherein
- the spoke has an aerofoil cross section.

3. The fuel injection nozzle for a gas turbine combustor according to claim 1, wherein
- the nozzle body has a swirler area where a swirler swirling air mixed with the fuel is provided, and
- the spoke is provided at the downstream of the flow of the air with respect to the swirler area.

4. The fuel injection nozzle for a gas turbine combustor according to claim 1, wherein
- the nozzle body has a swirler area where a swirler swirling air mixed with the fuel is provided, and
- the spoke is provided at the upstream of the flow of the air with respect to the swirler area.

5. The fuel injection nozzle for a gas turbine combustor according to claim 1, wherein
- the trailing edge is inclined toward the nozzle body.

6. A fuel injection nozzle for a gas turbine combustor comprising:
- a nozzle body that has a first cavity where fuel flows; and
- a spoke that is provided on the nozzle body and has
  - a leading edge,
  - a trailing edge forming a sweptforward angle of 10 to 30 degrees,
  - a second cavity connected to the first cavity, and
  - a hole from which the fuel is injected,
  - wherein the hole is provided on a side of the spoke at a distance from a surface of the nozzle body, wherein
- the spoke is provided so that a chord line connecting the leading edge and the trailing edge is nonparallel to the axis of the nozzle body.

7. A fuel injection nozzle for a gas turbine combustor comprising:
- a nozzle body that has a first cavity where fuel flows; and
- a spoke that is provided on the nozzle body and has
  - a leading edge, a trailing edge forming a sweptforward angle of 10 to 30 degrees, a second cavity connected to the first cavity, and a hole from which the fuel is injected, wherein the hole is provided on a side of the spoke at a distance from a surface of the nozzle body, and the distance is determined based on diffusion of the fuel, wherein the hole is provided on the trailing edge.

8. A fuel injection nozzle for a gas turbine combustor comprising:

a nozzle body that has a first cavity where fuel flows; and a spoke that is provided on the nozzle body and has a leading edge, a trailing edge forming a sweptforward angle of 10 to 30 degrees, a second cavity connected to the first cavity, and a hole from which the fuel is injected, wherein the hole is provided on a side of the spoke at a distance from a surface of the nozzle body, wherein the spoke has a taper.

9. A fuel injection nozzle for a gas turbine combustor comprising:

a nozzle body that has a first cavity where fuel flows; and a spoke that is provided on the nozzle body and has a leading edge, a trailing edge forming a sweptforward angle of 10 to 30 degrees, a second cavity connected to the first cavity, and a hole from which the fuel is injected, wherein the hole is provided on a side of the spoke at a distance from a surface of the nozzle body, wherein the spoke has such a cross section that a chord line connecting the leading edge and the trailing edge is curved.

10. A gas turbine combustor comprising:

a gas turbine combustor internal cylinder;

a first nozzle that is disposed inside the gas turbine combustor internal cylinder, and mixes pilot fuel with air to generate a diffusion flame;

a second nozzle that is provided on a circumference being concentric with the first nozzle, and mixes main fuel with air to generate a premixed flame;

a nozzle body that is included in either the first nozzle or the second nozzle;

a spoke that is provided on the nozzle body, the spoke having a trailing edge which forms a sweptforward angle of 10 to 30 degrees;

a diffusion corn that is attached at an outlet of the first nozzle to diffuse the pilot fuel mixed; and a premixed gas guide that is attached at the outlet of the second nozzle to guide the main fuel mixed to an inner peripheral surface of the gas turbine combustor internal cylinder.

11. The gas turbine combustor according to 10, wherein the premixed gas guide guides the main fuel mixed to the direction of a circumference being concentric with the first nozzle.

12. The gas turbine combustor according to claim 10, wherein the nozzle body is included in the first nozzle, the nozzle body has a first cavity where the pilot fuel flows, and the spoke that is provided on the nozzle body has a leading edge, the trailing edge, a second cavity connected to the first cavity, and a hole from which the pilot fuel is injected, wherein the hole is provided on a side of the spoke at a distance from a surface of the nozzle body, and the distance is determined based on diffusion of the pilot fuel.

13. The gas turbine combustor according to claim 12, wherein the spoke is provided at the upstream of the flow of the air with respect to an inlet of the first nozzle.

14. The gas turbine combustor according to claim 10, wherein the nozzle body is included in the second nozzle, the nozzle body has a first cavity where the main fuel flows, and the spoke that is provided on the nozzle body has a leading edge, the trailing edge, a second cavity connected to the first cavity, and a hole from which the main fuel is injected, wherein the hole is provided on a side of the spoke at a distance from a surface of the nozzle body, and the distance is determined based on diffusion of the main fuel.

15. The gas turbine combustor according to claim 14, wherein the spoke is provided at the upstream of the flow of the air with respect to the inlet of the second nozzle.

16. The gas turbine combustor according to claim 10, wherein the gas turbine combustor internal cylinder has a cooling unit positioned near the guide.

17. A gas turbine combustor comprising:

a gas turbine combustor internal cylinder;

a first nozzle that is disposed inside the gas turbine combustor internal cylinder, and has a first hole into which a main fuel flows;

a spoke that is provided on an inner peripheral surface of the first nozzle and has a leading edge, a trailing edge forming a sweptforward angle of 10 to 30 degrees, a cavity connected to the first hole, and a second hole from which the main fuel is injected; and a second nozzle that is disposed inside the first nozzle, and mixes pilot fuel with air.

18. The gas turbine combustor according to claim 17, wherein an end of the spoke is connected to the first hole, and other end of the spoke is connected to a surface of the second nozzle.

19. The gas turbine combustor according to claim 17, further comprising a combustion gas guide that is attached at the outlet of the first nozzle to guide the mixture of the main fuel, the pilot fuel, and the air to the inner peripheral surface of the gas turbine combustor internal cylinder.

20. A gas turbine comprising:

a compressor that compresses air;

a gas turbine combustor that generates combustion gas from the air, wherein the gas turbine combustor includes a gas turbine combustor internal cylinder;

a first nozzle that is disposed inside the gas turbine combustor internal cylinder, and mixes pilot fuel with air to generate a diffusion flame;

a second nozzle that is provided on a circumference being concentric with the first nozzle, and mixes main fuel with air to generate a premixed flame;

a nozzle body that is included in either the first nozzle or the second nozzle;

a spoke that is provided on the nozzle body, the spoke having a trailing edge which forms a sweptforward angle of 10 to 30 degrees;

a diffusion corn that is attached at an outlet of the first nozzle to diffuse the pilot fuel mixed; and a premixed gas guide that is attached at the outlet of the second nozzle to guide the main fuel mixed to an inner peripheral surface of the gas turbine combustor internal cylinder; and a turbine that is driven by the combustion gas generated.

21. A gas turbine comprising:

a compressor that compresses air;

a gas turbine combustor that generates combustion gas from the air, wherein the gas turbine combustor includes a gas turbine combustor internal cylinder;

a first nozzle that is disposed inside the gas turbine combustor internal cylinder, and has a first hole into which a main fuel flows;

a spoke that is provided on an inner peripheral surface of the first nozzle and has a leading edge, a trailing edge forming a sweptforward angle of 10 to 30 degrees, a cavity connected to the first hole, and a second hole from which the main fuel is injected; and a second nozzle that is disposed inside the first nozzle, and mixes pilot fuel with air; and a turbine that is driven by the combustion gas generated.

22. A fuel injection nozzle for a gas turbine combustor comprising:

a nozzle body that has a first cavity where fuel flows; and a spoke that is provided on the nozzle body and has a leading edge, a trailing edge, a second cavity connected to the first cavity, and a plurality of holes from which the fuel is injected, wherein a cross section of the spoke has a curved portion at the leading edge and a taper portion toward the trailing edge at a downstream portion of the curved portion, only an upstream portion of a side surface of the spoke, including the leading edge, is formed with a curved surface and other side surfaces are formed with plane surfaces at downstream portions of the curved surface, and ends of the plane surfaces meet at the trailing edge to form the taper portion in the cross section.

23. A fuel injection nozzle for a gas turbine combustor comprising:

a nozzle body that has a first cavity where fuel flows; and a spoke that is provided on the nozzle body and has a leading edge, a trailing edge, a second cavity connected to the first cavity, and a hole from which the fuel is injected, wherein the hole is provided on the trailing edge, wherein the trailing edge forms a sweptforward angle of 10 to 30 degrees.

* * * * *